US006044235A

United States Patent [19]

Hashimoto

[11] Patent Number: 6,044,235

[45] **Date of Patent: *Mar. 28, 2000**

[54] PROCESS CARTRIDGE HAVING RAISED FABRIC-LIKE CLEANING MEMBER

[75] Inventor: Kouji Hashimoto, Matsudo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/635,198

[22] Filed: Apr. 19, 1996

[30] Foreign Application Priority Data

Apr. 21, 1995 [JP] Japan ..... 7-096783

[51] Int. Cl.[7] ..... G03G 21/00

[52] U.S. Cl. ..... 399/99; 399/111; 399/343

[58] Field of Search ..... 355/296, 301, 355/200; 399/111, 116, 119, 159, 343, 350, 351, 287, 353, 352, 348, 114, 99

[56] References Cited

U.S. PATENT DOCUMENTS

| | | | |
|---|---|---|---|
| 3,615,813 | 10/1971 | Clarke et al. | 399/353 X |
| 3,692,402 | 9/1972 | Solarek | 399/287 |
| 3,725,059 | 4/1973 | Komp | 399/348 X |
| 3,740,864 | 6/1973 | Ito et al. | 399/352 |
| 4,835,807 | 6/1989 | Swift | 399/353 X |
| 5,023,660 | 6/1991 | Ebata et al. | 399/111 |
| 5,502,547 | 3/1996 | Shirai | 399/111 X |
| 5,589,918 | 12/1996 | Oshida et al. | 399/114 |

FOREIGN PATENT DOCUMENTS

| | | | |
|---|---|---|---|
| 58-85447 | 5/1983 | Japan | 355/296 |
| 60-60677 | 4/1985 | Japan | 355/301 |
| 63-183477 | 7/1988 | Japan | 355/301 |
| 4-52668 | 2/1992 | Japan | 355/296 |
| 5-134482 | 5/1993 | Japan . | |

*Primary Examiner*—Susan S. Y. Lee

*Attorney, Agent, or Firm*—Fitzpatrick, Cella, Harper & Scinto

[57] ABSTRACT

The process cartridge has a rotatable member having an electrophotographic photosensitive layer, the rotatable member having an abut surface against which a spacer for keeping a distance between the electrophotographic photosensitive layer and a spacer opposed thereto at a predetermined value, a process device acting on the electrophotographic photosensitive layer, and a raised fabric-like cleaning member abutted against the abut surface. The raised fabric-like cleaning member includes fibers of which distal ends are bent and inclined in a direction counter to a rotational direction of the drum-like rotatable member. The raised fabric-like cleaning member stores toner removed from the drum-like rotatable member therein.

4 Claims, 22 Drawing Sheets

PROCESS CARTRIDGE HAVING RAISED FABRIC-LIKE CLEANING MEMBER

BACKGROUND OF THE INVENTION

1. Field of the Invention

This invention relates to an image forming apparatus using the electrophotographic art and to a process cartridge removably mountable to a body of this image forming apparatus.

The term "image forming apparatus" covers, for example, electrophotographic copying apparatuses, electrophotographic printers (such as LED printers and laser beam printers), electrophotographic facsimile apparatuses, etc.

2. Description of the Related Art

In an image forming apparatus using the electrophotographic image forming process, there has heretofore been adopted a process cartridge system in which an electrophotographic photosensitive member and process means acting on the electrophotographic photosensitive member are integrally made into a cartridge and the cartridge is made removably mountable to the body of the image forming apparatus. According to this process cartridge system, the maintenance of the apparatus can be done by a user himself without resorting to a serviceman and therefore, the operability of the apparatus could be markedly improved. So, this process cartridge system is widely used in image forming apparatuses.

Now, the distance between a photosensitive member and a developing sleeve must usually be kept at the order of several hundred p m. In order to keep this distance, rollers (spacers) slightly larger than the diameter of the sleeve are mounted near the opposite ends of the developing sleeve and these rollers are abutted against the opposite ends of the photosensitive drum. However, if a toner adheres to the surface of the photosensitive drum against which the rollers are abutted, the distance between the developing sleeve and the photosensitive drum will not be correct.

SUMMARY OF THE INVENTION

The present invention has been made in view of the above-noted problem and an object thereof is to provide a process cartridge in which the distance between a developing sleeve and a photosensitive member can be kept constant for a long period and an image forming apparatus in which this process cartridge is removably mountable.

Another object of the present invention is to provide a process cartridge provided with a cleaning member capable of collecting a toner removed from the surface of a photosensitive drum against which the rollers of a developing sleeve are abutted in a great quantity and an image forming apparatus in which this process cartridge is removably mountable.

Still another object of the present invention is to provide a process cartridge in which a raised fabric-like cleaning member abuts against the surface of a photosensitive drum against which rollers abut and an image forming apparatus in which this process cartridge is removably mountable.

Further objects of the present invention will become apparent from the following detailed description taken in conjunction with the accompanying drawings.

DESCRIPTION OF THE PREFERRED EMBODIMENTS

An embodiment of an electrophotographic image forming apparatus to which the present invention is applied will first be specifically described with reference to the drawings. Herein a full color laser beam printer A capable of forming a full color image by the use of a plurality of developing means is exemplarily shown as a form of the electrophotographic image forming apparatus, and a process cartridge B is removably mountable therein as will be described later.

Figure 1:
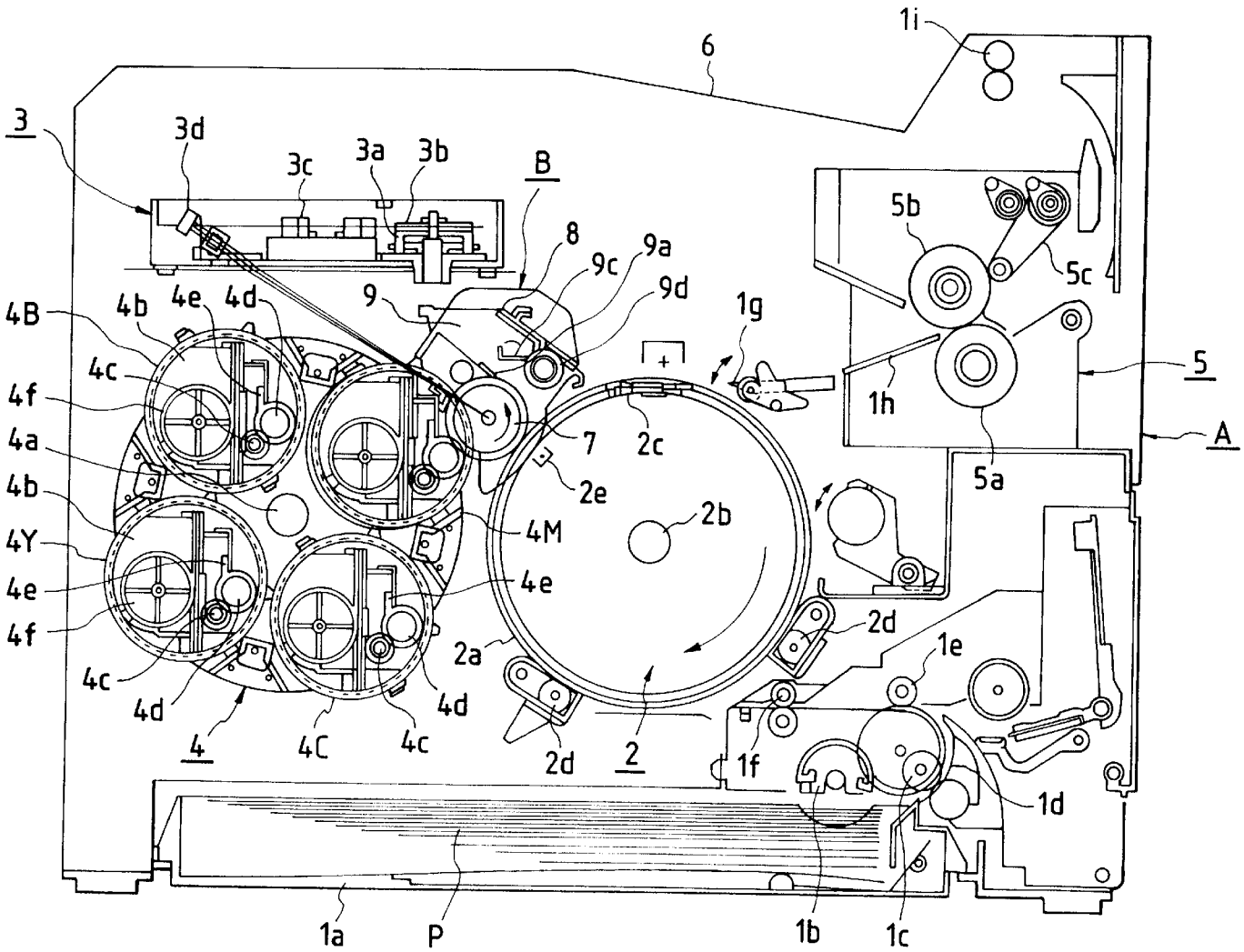
FIG. 1 is a cross-sectional view of a full color electrophotographic image forming apparatus.
Figure 2:
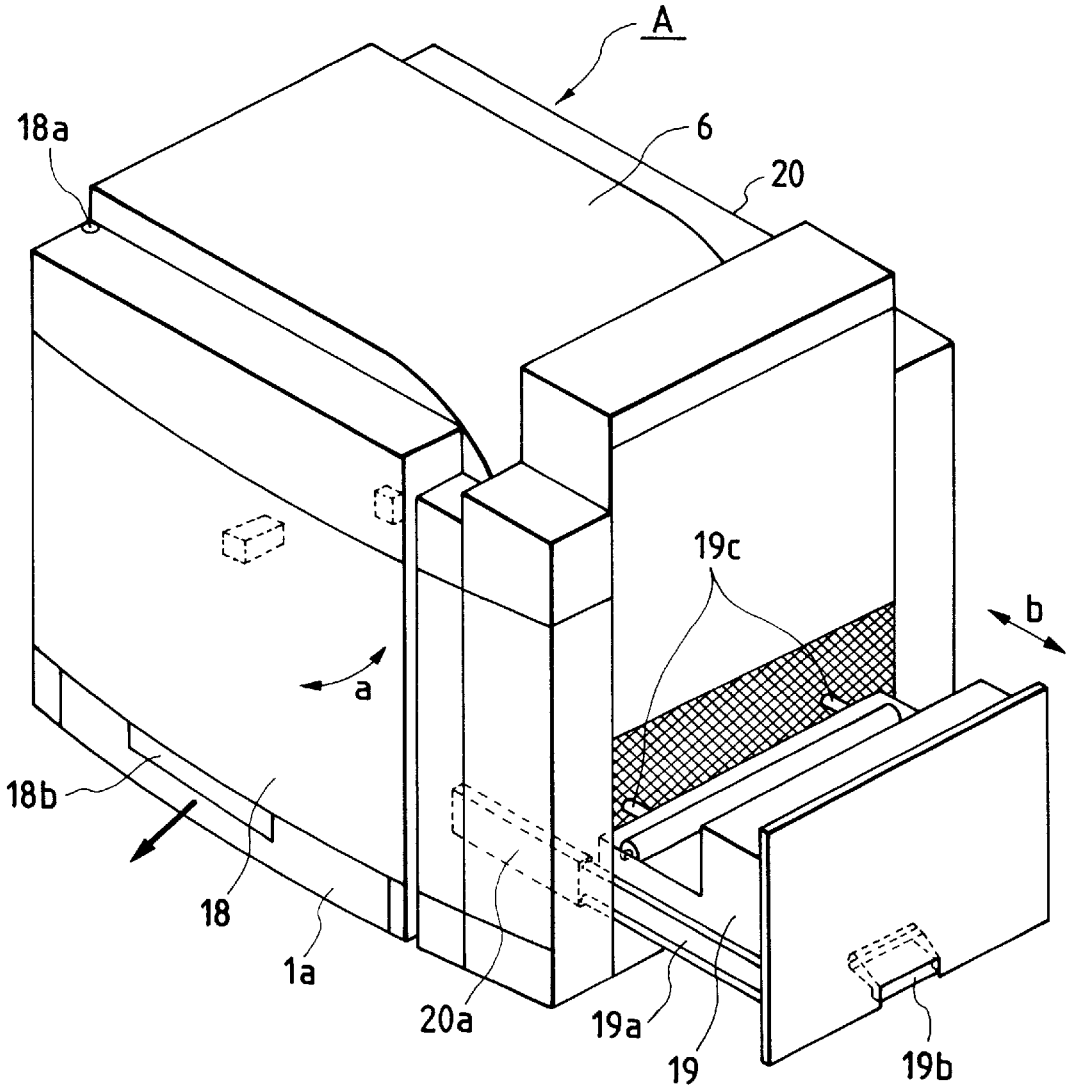
FIG. 2 is a perspective view of the apparatus of FIG. 1.
Figure 3:
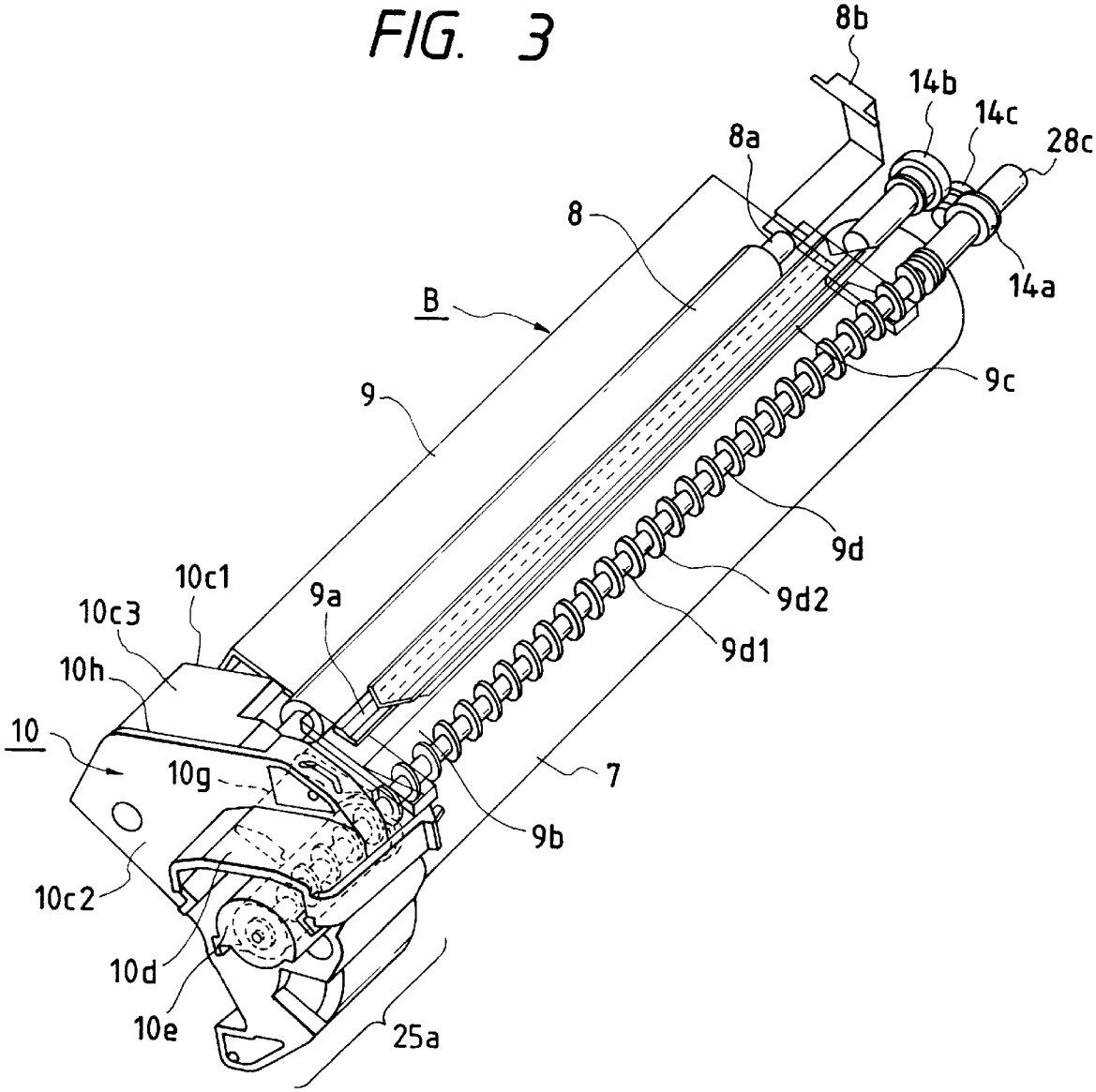
FIG. 3 is a perspective view of a process cartridge.
Figure 4A:
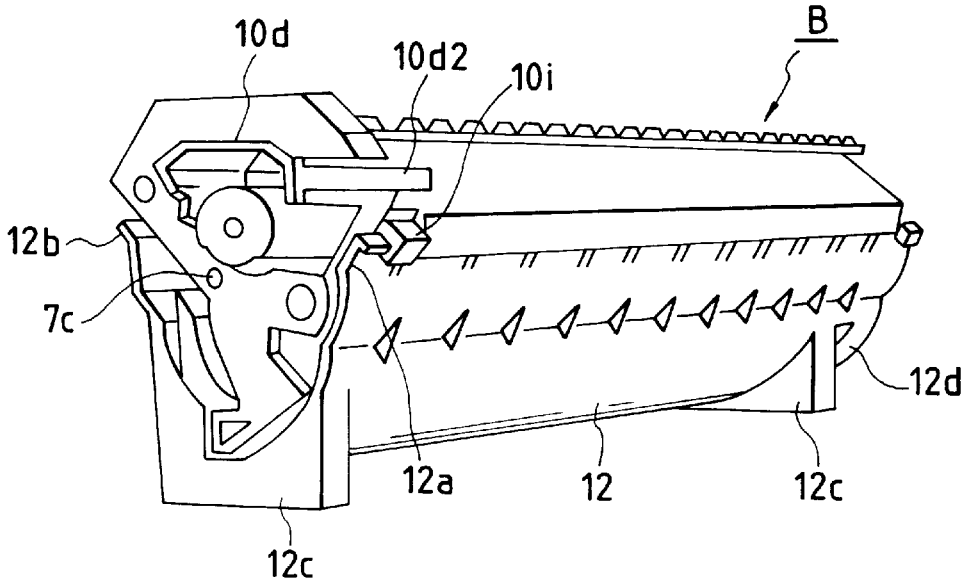
FIGS. 4A and 4B are pictorial views of the process cartridge.
Figure 4B:
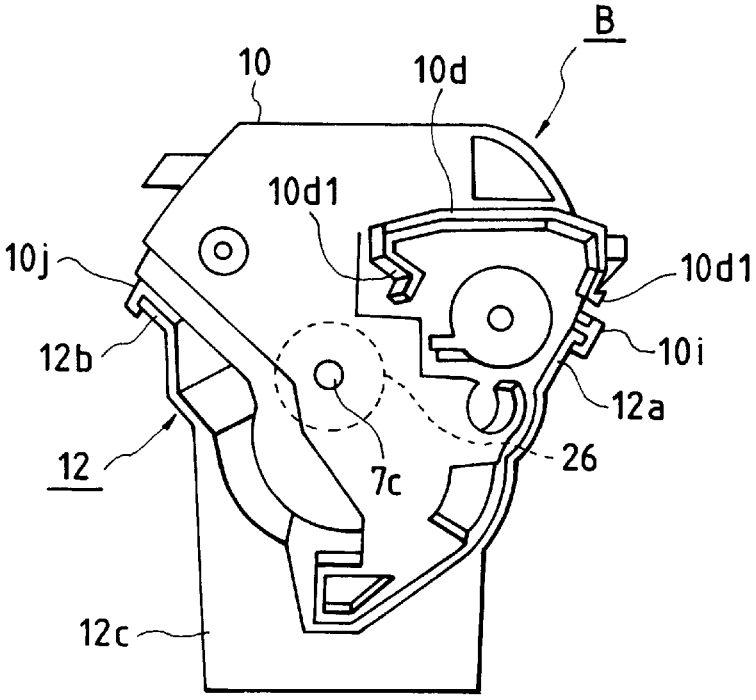
Figure 5A:
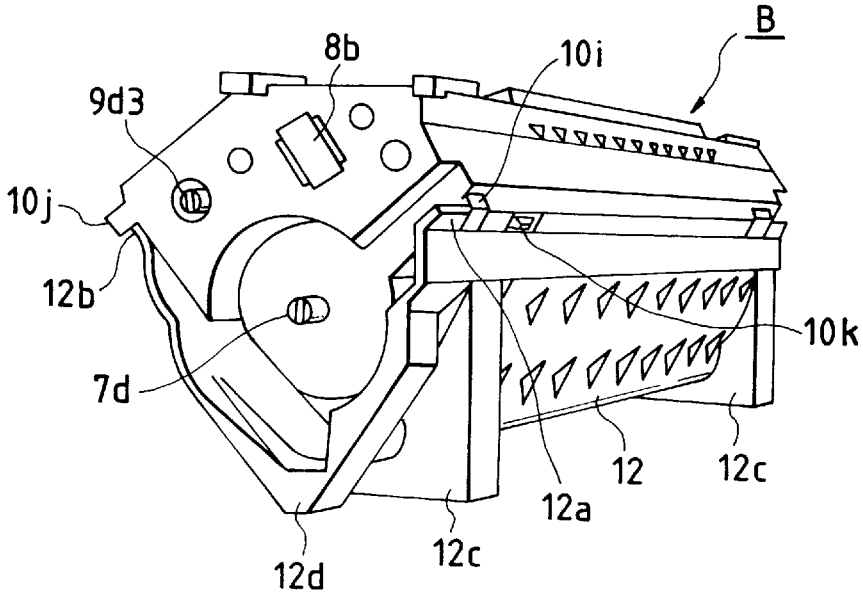
FIGS. 5A and 5B are pictorial views of the process cartridge.
Figure 5B:
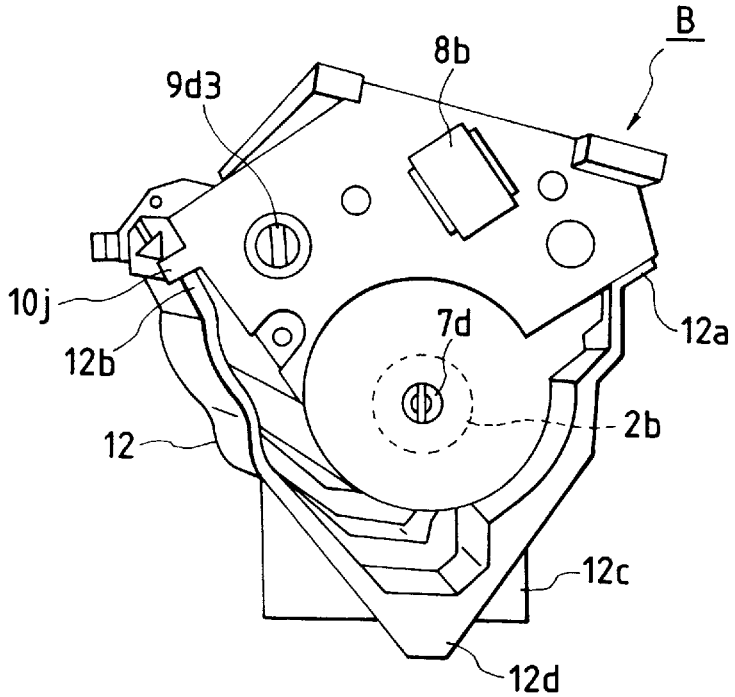

The process cartridge and the full color laser beam printer will first be specifically described. FIG. 1 is a cross-sectional view of the full color laser beam printer, and FIG. 2 is a pictorial perspective view thereof. FIG. 3 is a perspective view showing the internal construction (a state in which a portion of a frame member has been removed) of the process cartridge, and FIGS. 4 and 5 are pictorial views of the process cartridge. Herein, the general construction of the full color laser beam printer and the construction of each portion thereof will first be described, and then the construction of the process cartridge and the construction of each portion thereof will be described.

{General Construction of the Image Forming Apparatus}

First, schematically describing the general construction of the full color laser beam printer A, in this apparatus, as shown in FIG. 1, a recording medium P is conveyed by conveying means 1 and is wound on a transfer drum 2*a* constituting transfer means 2. In synchronism therewith, an optical image is applied from a scanner unit 3 to a photosensitive drum 7, which is a drum-shaped electrophotographic photosensitive member in the process cartridge B, to thereby form a latent image. A developing unit 4 comprising four developing means is then operated to thereby form an image by a developer (hereinafter referred to as the "toner") corresponding to each color, and the images are successively transferred to the recording medium P so that the respective colors may be superposed one upon another. The recording medium P after the transfer of the toner image is then conveyed to fixating means 5, whereby the toner image is fixated. Thereafter the recording medium P is discharged to a discharge portion 6 on top of the apparatus.

In the above-described color image forming apparatus A, the process cartridge B, the developing means (or the toner cartridges) of the developing unit 4 and a feed cassette 1*a* as a recording medium cassette are removably mountable from the same direction (this side as viewed in FIG. 1) of the apparatus body. The mounting and dismounting of these are effected by opening and closing an openable-closable cover 18 openable and closable in the direction of arrow a relative to the printer body 20 about a shaft 18*a*, relative to the printer body 20. In this manner, the openable-closable cover 18 is opened and closed to effect the maintenance (including jam treatment, etc.) of the apparatus. The reference character 18*b* designates a handle for use for the mounting and dismounting of-the feed cassette 1*a*.

The constructions of the various portions of the above-described color image forming apparatus will now be successively described in detail.

(Conveying Means)

The conveying means serves to convey the recording mediums P piled and contained in the feed cassette 1*a*, and feeds out the recording mediums P in the feed cassette 1*a* removably mounted on the bottom of the apparatus one by one by a pickup roller 1*b* and a feed roller 1*c*. The recording medium P thus fed out is conveyed to a pair of register rollers 1*f* by a guide plate 1*d* and a relay roller 1*e*, and is timed by the pair of register rollers 1*f* and conveyed to the transfer drum 2*a*.

Also, the recording medium P after the transfer is separated from the transfer drum 2*a* by a separating member 1*g* and is conveyed to the fixating means 5 by a guide plate 1*h*, and the recording medium P after the fixation is discharged to the discharge portion 6 provided on the upper surface of the apparatus, by a pair of discharge rollers 1*i*.

Also, as shown in FIG. 2, the rollers 1*b*, 1*c*, 1*e*, 1*f* and the guide 1*d* are made integral as a feed unit 19, which can be inserted and removed in the direction of arrow b. That is, the feed unit 19 has its rail 19*a* slidably supported by a guide 20*a* on the printer body 20 side, and is adapted to be inserted or removed in the direction of arrow b by means of a handle 19*b*. Positioning shafts 19*c* are provided on the feed unit 19, and when the feed unit 19 is inserted and mounted in the printer body 20, the positioning shafts 19*c* fit into fitting holes (not shown) in the printer body 20, and the feed unit 19 is positioned and fixed to the printer body 20.

(Transfer Means)

The transfer means serves to transfer the toner images formed on the photosensitive drum 7 to the recording medium P, and is designed to wind the recording medium P on the transfer drum 2*a* rotated in the direction of arrow in FIG. 1 to thereby successively transfer the colored toner images to the recording medium P in superposed relationship with one another. The transfer drum 2*a* has a dielectric material layer on the outermost periphery thereof and is adapted to receive a drive force from a drive motor (not shown) and be rotatively driven about a shaft 2*b*. The transfer drum has a gripper 2*c* at a predetermined location on the outer periphery thereof, and this gripper 2*c* serves to grip the leading end of the recording medium P conveyed thereto by the pair of register rollers 1*f*.

Also, an electrostatic sucking roller 2*d* movable toward and away from the transfer drum 2*a* is provided near the outer periphery of the drum 2*a*, and is in pressure contact with the transfer drum 2*a* in such a manner as to sandwich the recording medium P between the electrostatic sucking roller 2*d* and the transfer drum 2*a*. By a voltage being applied to between the electrostatic sucking roller 2*d* and the transfer drum 2*a*, charges are induced in the recording medium P which is a dielectric material and the dielectric material layer of the transfer drum 2*a*, whereby the recording medium P is electrostatically sucked to the outer periphery of the transfer drum 2*a*. In the transfer drum 2*a* opposed to the photosensitive drum 7, there is provided a transfer charger 2*e* for applying a voltage of a polarity opposite to that of the toner images on the photosensitive drum 7 to thereby effect the transfer of the toner images when the recording medium P held on the transfer drum 2*a* comes into contact with the photosensitive drum 7.

As a method of sucking the recording medium P to the transfer drum 2*a*, the above-described electrostatic suction is not restrictive, but a suction method using the air is also possible.

(Scanner Unit)

The scanner unit 3 serves to apply a laser beam conforming to an image signal to the photosensitive drum 7. That is, this scanner unit 3 is adapted to scan the light from a laser diode 3*a* emitting light for each color in conformity with the image signal by a rotating polygon mirror 3*b*, and apply it to the photosensitive drum 7 through the intermediary of an imaging lens 3*c* and a reflecting mirror 3*d* to thereby form latent images.

(Developing Means)

The developing unit 4 serves to develop the latent images formed on the photosensitive drum 7 by respective ones of magenta, cyan, yellow and block toners to thereby visualize them. The developing unit has developing means for effecting development in the aforementioned respective color toners (magenta developing means 4M, cyan developing means 4C, yellow developing means 4Y and black developing means 4B).

The four developing means 4M, 4C, 4Y and 4B are rotatable by a rotating mechanism (not shown) so that the respective developing means 4M, 4C, 4Y and 4B may become successively opposed to the photosensitive drum 7 in conformity with the image forming operation. The developing means 4M, 4C, 4Y and 4B are disposed for index rotation at each angle of 90° about a rotary shaft 4*a*. Further, the developing means 4M, 4C, 4Y and 4B are designed such that the center of each of them rotates in operative association with a rotating gear (not shown) disposed on the outer periphery of a revolving gear (not shown) and that their postures are always kept constant. The developing means 4M, 4C, 4Y and 4B are similar in construction to one another with the exception that toners of different colors are contained therein, and each of them has a toner container 4*b*, an application roller 4*c*, a developing roller 4*d*, a developing blade 4*e*, spacing holding members 4*g*, etc.

In case of image formation, the developing means 4M, 4C, 4Y and 4B corresponding to the respective colors, i.e., magenta, cyan, yellow and black, are rotatively moved about the shaft 4*a*, and one of the developing means 4M, 4C, 4Y and 4B is stopped at a position opposed to the photosensitive drum 7, and the spacing holding members 4*g* disposed on the opposite end portions of the developing roller 4*d* bear against the opposite ends of the photosensitive drum 7 and are positioned so as to be opposed to the photosensitive drum with a minute gap (of the order of about 200 to 600 μm), whereafter a toner image by each color toner is successively formed on the photosensitive drum 7. That is, each of the developing means 4M, 4C, 4Y and 4B supplies the toner in the toner container 4*b* corresponding to the color for development into the application roller 4*c* by a supplying mechanism, and forms a toner layer on the outer periphery of the rotating developing roller 4*d* by the rotating application roller 4*c* and the developing blade 4*e* and imparts charges (frictional charging) to the toner. A developing bias is applied between this developing roller 4*d* and the photosensitive drum 7 on which the latent images have been formed, whereby toner development is effected on the photosensitive drum 7 in conformity with the latent images.

Also, for the supply of the toner to the toner container 4*b*, a mounting portion for making a cylindrical toner cartridge 4*f* removably mountable is provided on the toner container 4*b*, and the toner cartridge 4*f* is mountable to the mounting portion by being inserted in the lengthwise direction thereof (from this side toward the inner side of the apparatus shown in FIG. 1). Although not shown, during the supply of the toners, when the developing means 4M, 4C, 4Y and 4B are successively rotated by 90° each about the rotary shaft 4*a*, the cartridge mounting portions successively change places, and at a predetermined position, the toner cartridge 4*f* can be axially drawn out and interchanged.

(Fixating Means)

The fixating means 5 serves to fixate the toner transferred onto the recording medium P. As shown in FIG. 1, it comprises a rotatively driven drive roller 5*a* and a fixating roller 5*b* adapted to be brought into pressure contact therewith and apply heat and pressure to the recording medium P. The recording medium P separated from the transfer drum 2*a* is conveyed by the drive roller 5*a* and has heat and pressure applied thereto by the fixating roller 5*b* when it passes the fixating means 5. Thereby, the unfixated toner images transferred to the recording medium P are fixated.

A cleaning member 5*c* is in contact with the fixating roller 5*b*, and design is made such that the toners adhering to the roller 5*b* are removed by the cleaning member 5*c* and at the same time, an offset preventing agent is applied thereto.

(Construction of the Process Cartridge)

The process cartridge B, as shown in FIGS. 1 and 3, comprises the photosensitive drum 7 which is a drum-shaped electrophotographic photosensitive member and at least one process means acting on the drum 7, the photosensitive drum 7 and the process means being constructed as a unit. In the present embodiment, as the process means, primary charging means 8 and cleaning means 9 are incorporated into a cartridge frame member 10 and made into a unit. The process cartridge B has a removably mountable protective cover for protecting the exposed portion of the photosensitive drum 7 when the process cartridge is not mounted.

The constructions of the various portions of the process cartridge will now be successively described in detail.

(Electrophotographic Photosensitive Member)

Figure 6:
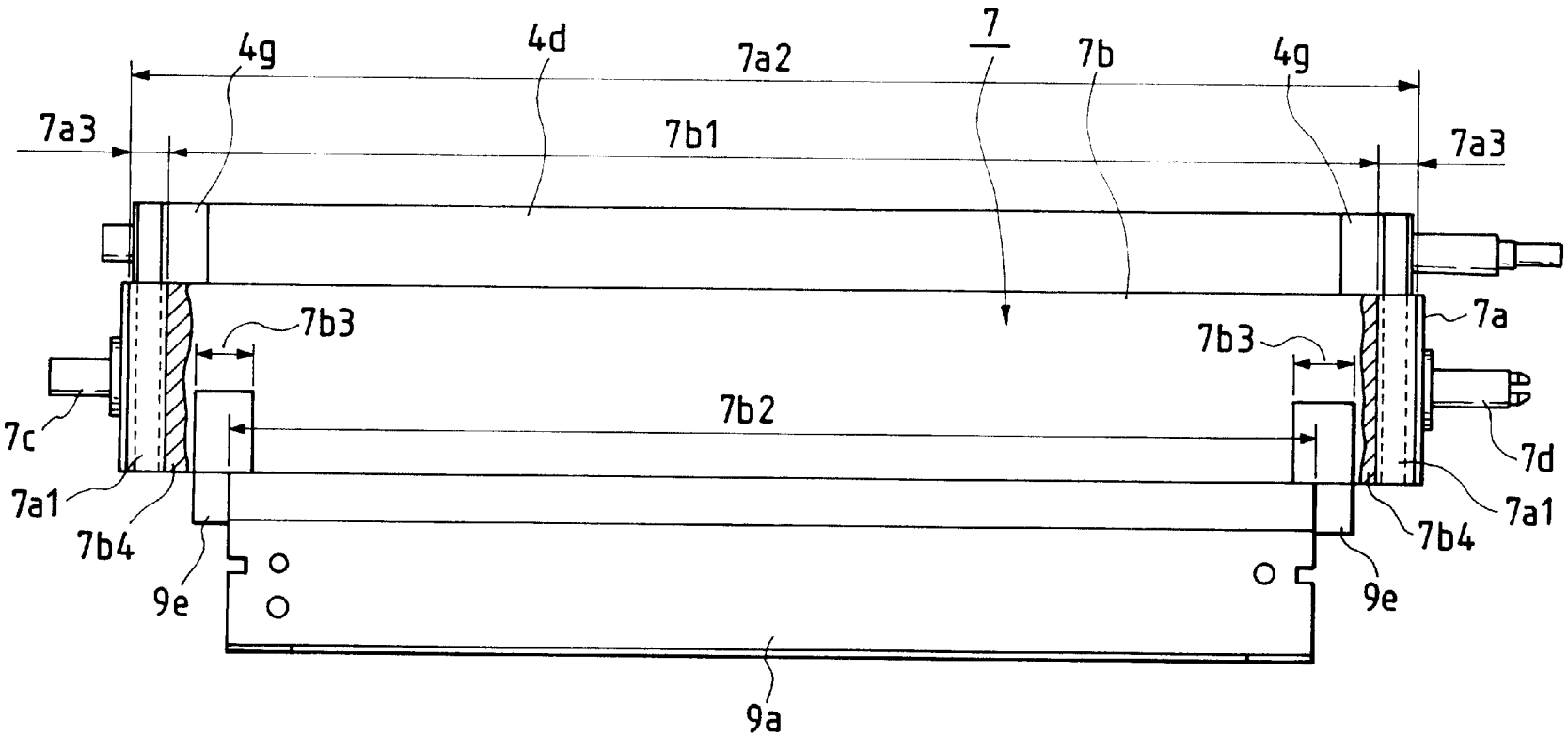
FIG. 6 is a schematic view showing the bearing area of each member bearing against and acting on an electrophotographic photosensitive member.

In the present embodiment, the drum-shaped photosensitive drum 7 is used, which is adapted to be rotated in the direction of arrow in FIG. 1 during image formation. This photosensitive drum 7, as shown in FIG. 6, has an organic photoconductive layer (photosensitive layer) 7*b* formed on the outer peripheral surface of an aluminum cylinder 7*a* as an electrically conductive base body. The photosensitive layer 7*b* of the photosensitive drum 7 is formed so that the photosensitive layer area 7*b*1 thereof may be longer than the length of a bearing area 7*b*2 against a cleaning blade 9*a* for removing any untransferred toner on the photosensitive drum 7, plus the length of a bearing area 7*b*3 against a seal member 9*e* for preventing the toner from leaking from the opposite end portions of the blade 9*a* to the lengthwisely opposite ends of the drum.

Thereby, the cleaning member 9*a* and the toner leakage preventing seal member 9*e* is not abutted against the photosensitive layer irregularity areas 7*b*4 of the end portions of the photosensitive layer created by liquid drip and separation irregularity during the formation of the photosensitive layer, and unsatisfactory cleaning, toner leakage, etc. can be prevented from occurring due to a slight level difference or the like on the electrophotographic photosensitive member by the photosensitive layer irregularity areas 7*b*4.

Also, the length 7*a*2 of the aluminum cylinder 7*a* of the photosensitive drum 7 is greater than the length of the photosensitive layer area 7*b*1 plus the length of the bearing area 7*a*1 against the spacing holding member 4*g* for keeping the spacing between the developing roller 4*d* and the photosensitive drum 7 constant. The spacing holding member 4*g* is abutted against the photosensitive layer area 7*b*3 which is outside the photosensitive layer area 7*b*1. Thus, the spacing holding member 4*g* is not abutted against the photosensitive layer irregularity areas 7*b*4 of the end portions of the photosensitive layer created by liquid drip or separation irregularity during the formation of the photosensitive layer, and unsatisfactory images or the like can be prevented from occurring due to the slight fluctuation of the spacing between the developing roller 4*d* and the photosensitive drum 7.

The electrophotographic photosensitive member is not restricted to the photosensitive drum 7. For example, as the photosensitive material, a photoconductive material is used, which includes, for example, amorphous silicon, amorphous selenium, zinc oxide, titanium oxide and the aforementioned organic photoconductive material (OPC). Also, shapes carrying the photosensitive material thereon include, for example, a drum-like or belt-like rotatable member and a sheet-like member. Generally, the drum-like or belt-like member is used, and in the drum type photosensitive member, a photoconductive material is applied or deposited by evaporation onto a cylinder of an aluminum alloy or the like, as previously described.

(Support Shaft of Electrophotographic Photosensitive Member)

Figure 7:
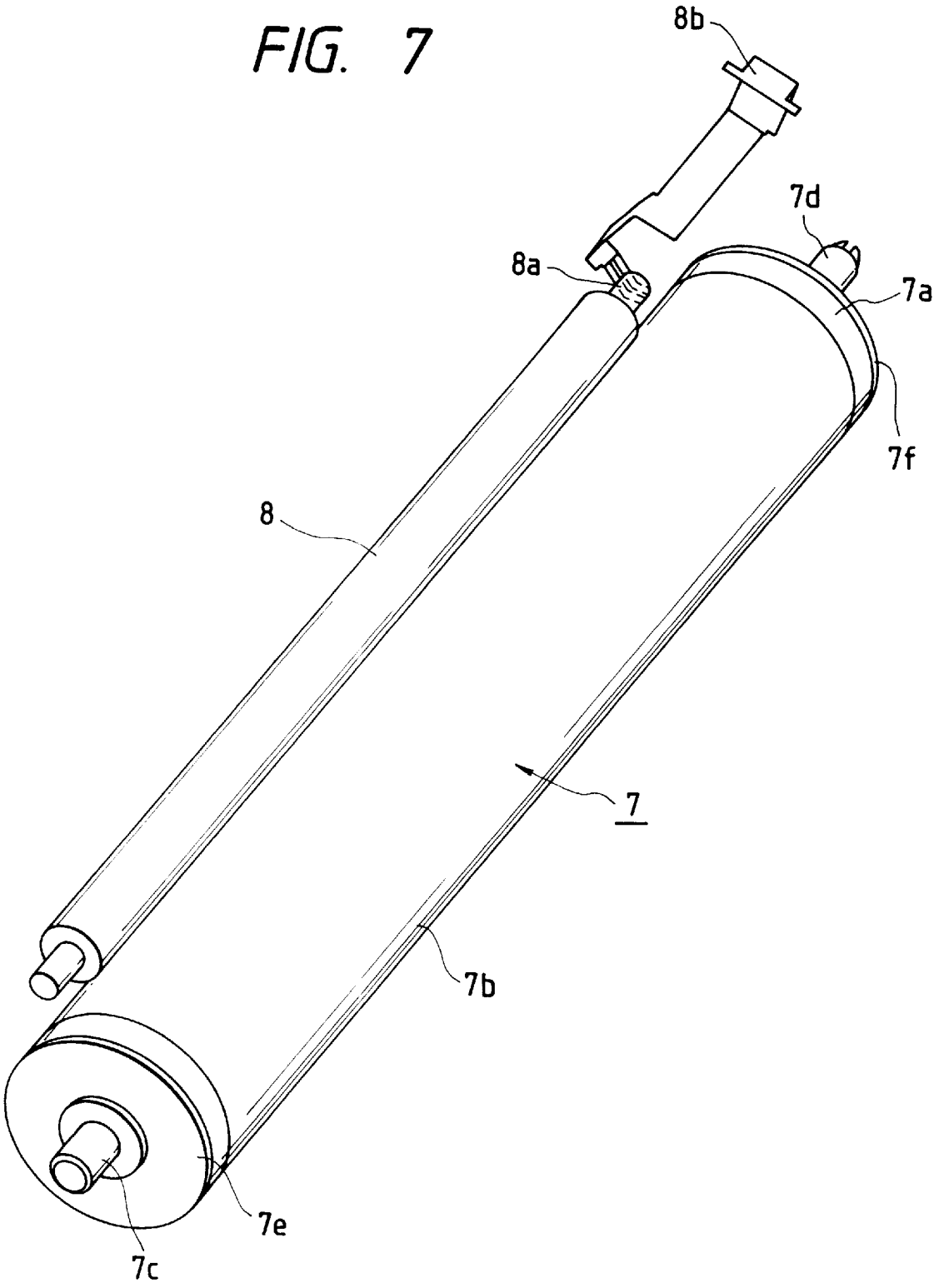
FIG. 7 is an enlarged perspective view of a photosensitive drum and a charging roller.

The photosensitive drum 7, as shown in FIG. 7, has a photosensitive member supporting shaft 7*c* and a tip-split shaft 7*d* which provide the center of rotation on the lengthwisely opposite ends thereof (this side and the inner side as viewed in the direction of insertion of the cartridge). The photosensitive member supporting shaft 7*c* and the tip-split shaft 7*d* are formed integrally with drum flanges 7*e* and 7*f*, respectively, assembled to the opposite ends of a drum cylinder 7*a*. The drum flange 7*e* integrally having the photosensitive member supporting shaft 7*c* and the drum flange 7*f* integrally having the tip-split shaft 7*d* are forced into this side and the inner side of the drum cylinder 7*a* and assembled thereto as by adhesion or caulking to thereby construct the photosensitive drum 7.

Here, in order to make the photosensitive member supporting shaft 7*c* and the tip-split shaft 7*d* coincident with an axis (broken line in FIG. 7) passing through the center of rotation of the photosensitive drum 7, the making of the drum flange 7*e* on this side and the drum flange 7*f* on the inner side is accurately done by a method such as bulk cutting. That is, if the coaxility of the fit-in portion of the photosensitive member supporting shaft 7*c* and the fit portion thereof to the drum cylinder 7*a* in the case of the flange 7*e* and the fit-in portion of the tip-split shaft 7*d* and the fit portion thereof to the drum cylinder 7*a* in the case of the flange 7*f* is made accurate, the photosensitive member supporting shaft 7*c* and the tip-split shaft 7*d* can be easily made coincident with the axis passing through the center of rotation of the photosensitive drum 7. Consequently, the vibration or the like during the rotation of the photosensitive drum 7 due to the aggravation of the accuracy of the coaxiality of the shafts 7*c* and 7*d* can be minimized and the occurrence of unsatisfactory images can be reduced.

Figure 8:
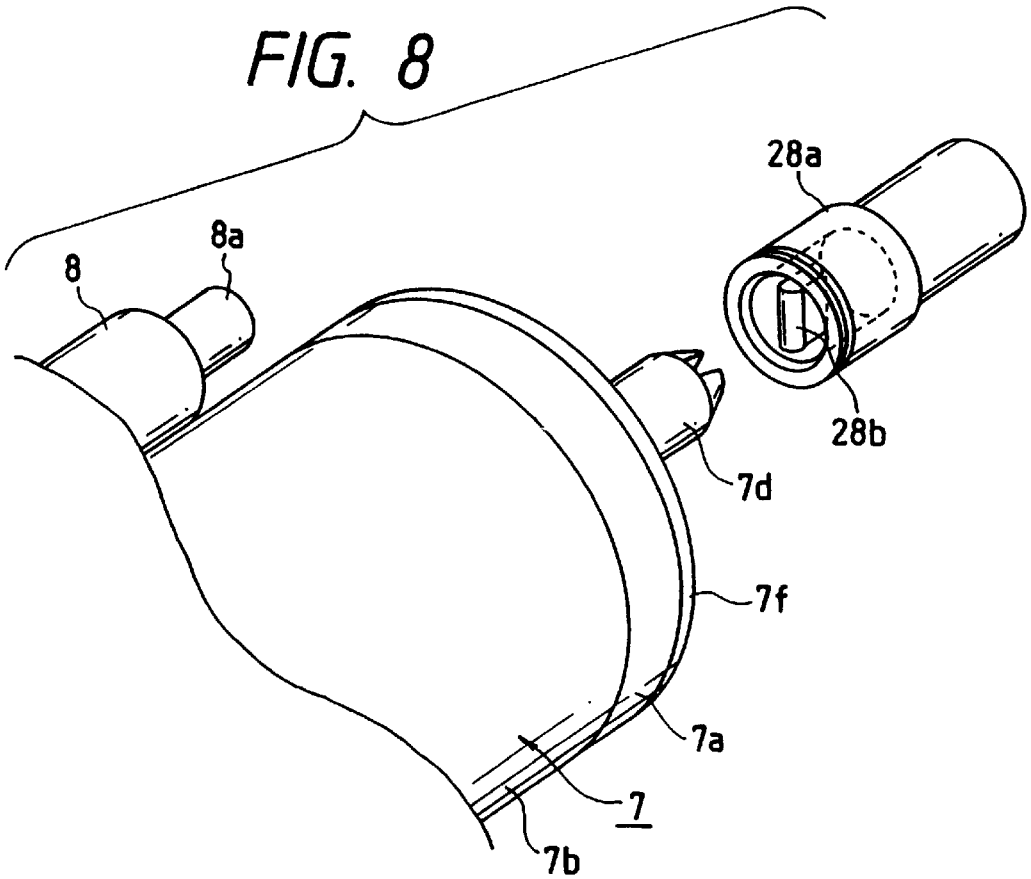
FIG. 8 is an enlarged perspective view of the tip-split shaft of the photosensitive drum and the drive shaft portion of the apparatus body.

Also, the tip-split shaft 7*d* which is the tip end side in the direction of insertion of the cartridges, as can be seen from FIG. 8, has its tip end formed into a tip-split shape so as to be directly connected to a drive mechanism on the apparatus body side during the mounting of the cartridge. Accordingly, when the process cartridge B is inserted and mounted in the image forming apparatus body, the outer diameter portion of the tip-split shaft 7*d* fits to the inner diameter portion of a drive shaft 28*a* on the apparatus body side and at the same time, a drive piece 28*b* in the drive shaft 28*a* comes into the tip-split portion of the tip-split shaft 7*d*, whereby the photosensitive drum 7 is connected to the drive mechanism on the apparatus body. The drive shaft 28*a* and the drive piece 28*b* are rotated with each other and therefore, when the drive shaft 28*a* is rotated, the photosensitive drum 7 is also rotated. Thus, the photosensitive drum 7 can be rotated without the use of a gear or the like and therefore, the occurrence of unsatisfactory images caused by the pitch irregularity or the like of the gear can be suppressed.

Also, in the present embodiment, the tip-split shaft 7*d* of the photosensitive drum 7 is designed to serve also as an electrically conductive member for the grounding of the photosensitive drum 7 and an electrically conductive member for detecting the life of the photosensitive drum 7. The photosensitive drum 7 has its surface uniformly charged by a primary charging roller 8. That is, as shown in FIG. 7, the primary charging roller 8 receives a primary charging bias from the apparatus body through a contact plate 8*b* and this bias is imparted to the photosensitive drum 7. At this time, the photosensitive drum 7 has its drum cylinder 7*a* and tip-split shaft 7*d* electrically conducted by a grounded plate (not shown) and as a result, the tip-split shaft 7*d* becomes a grounded shaft. Further, by detecting the current value of this portion, any change in the film thickness of the photosensitive layer 7*b* of the photosensitive drum 7 can be detected to thereby detect the life of the photosensitive drum 7. Consequently, an electrically conductive member for detecting the film thickness of the photosensitive layer 7*b* need not be provided discretely and thus, a reduction in cost by a decrease in the number of parts can be achieved.

(Seal Member)

Figure 9:
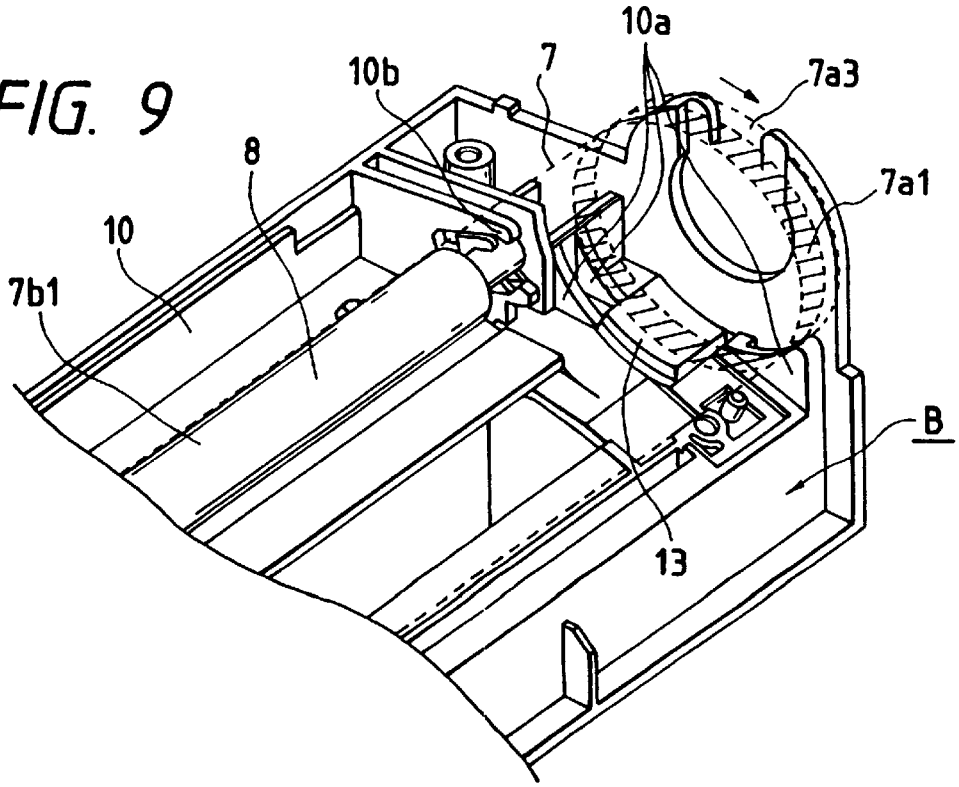
FIG. 9 is a broken-away perspective view of a cartridge frame member.
Figure 10:
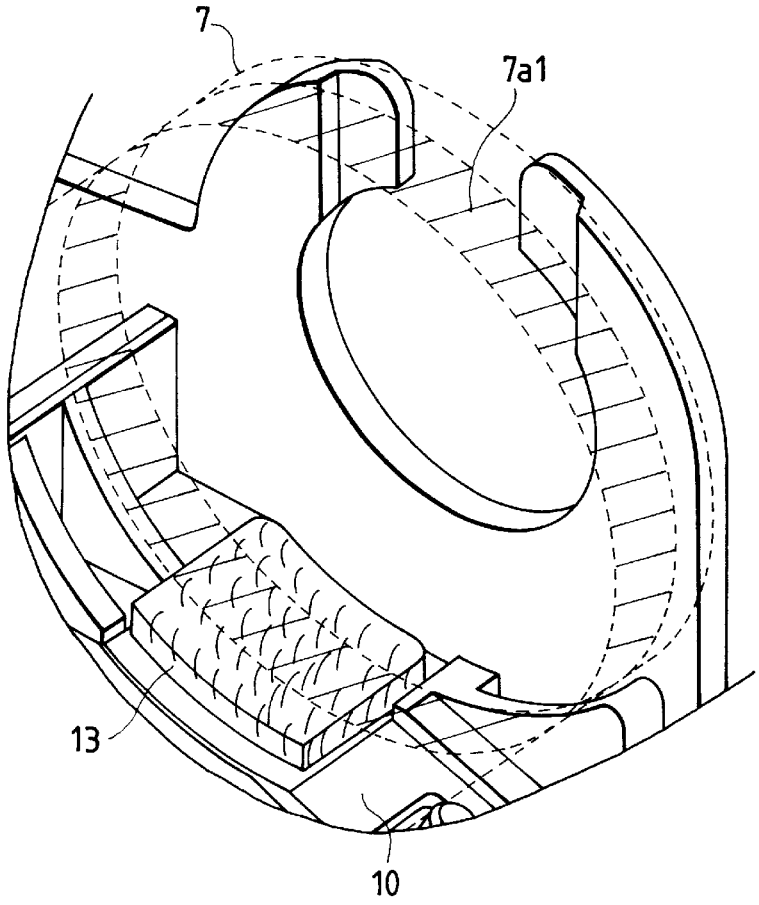
FIG. 10 is an enlarged view of the cartridge showing the direction of fall of the raised fiber of a seal member.
Figure 11A:
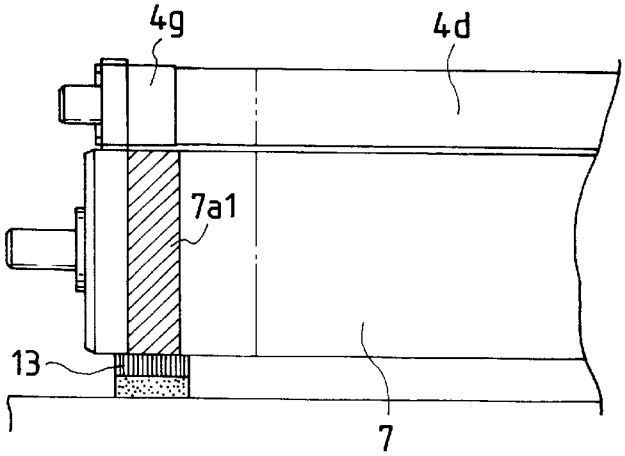
FIGS. 11A and 11B are schematic views showing the relations among the electrophotographic photosensitive member, a developing roller and the seal member.
Figure 11B:
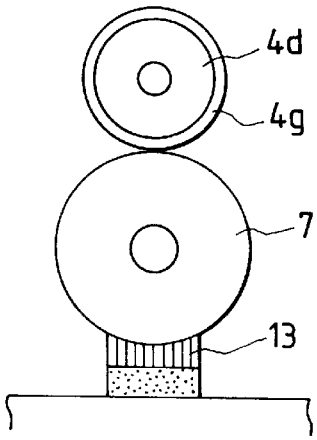

Also, as shown in FIGS. 9 and 10, raised fabric-like seal members 13 are disposed on the lengthwisely opposite ends of a cartridge frame member 10 supporting the opposite ends of the photosensitive drum 7. These raised fabric-like seal members 13 are disposed so as to always contact with the bearing peripheral surface 7*a*1 (hatched portion in the figures) of the photosensitive drum against which the spacing holding members 4*g* on the opposite ends of the developing roller 4*d* bear (see FIG. 11), and wipes off the toner or the like adhering to the bearing peripheral surface 7*a*1 of the photosensitive drum 7 during the rotation of the drum and stores them in the raised fiber. Thereby, the spacing between the photosensitive drum 7 and the developing roller 4*d* can be kept proper and the scattering or the like of the wiped-off toner toward around the drum can be prevented.

Also, the raised fabric-like seal members 13, as shown in FIG. 10, are disposed so that the direction of fall of the raised fiber thereof may be perpendicular to the direction of rotation of the photosensitive drum 7. Thus, the raised fiber of the seal members 13 provides a pseudo-wall against the peripheral surface of the photosensitive drum 7 in the direction of rotation thereof, and even if durability progresses and the wiped-off toner amount become large, it will be difficult for the toner to blow out toward the opposite side of the seal members 13 (the downstream side with respect to the direction of rotation of the photosensitive drum 7). Here, as simple means for storing all the wiped-off toner, for example, the size of the seal members 13 can be made large. Thereby, the quantity of the toner capable of being stored can be increased and even if specially difficult setting is not effected, the number of durable sheets or the like can be made great.

In the present embodiment, as the seal members 13, use is made of two-layer seal members of which the side bearing against the peripheral surface of the photosensitive drum 7 is a raised fabric-like member and the cartridge frame member side is an elastic member of sponge or the like.

Also, the cartridge frame member 10 is provided with arcuate ribs 10*a* concentric with the photosensitive drum 7 on the portions thereof (the lengthwisely opposite ends) facing the non-photosensitive layer areas 7*a*3 of the photosensitive drum 7, and tie portion thereof facing the photosensitive layer area 7*b*1 of the photosensitive drum 7 (for example, the bearing rib 10*b* of the primary charging means 8) is disposed so as not to protrude from the arcuate portion of the arcuate rib 10*b* toward the center of the drum. Thus, when the photosensitive drum 7 is incorporated into the cartridge frame member 10, only the non-photosensitive layer areas 7*a*3 of the photosensitive drum 7 is abutted against the cartridge frame member 10 (the arcuate ribs 10*a*) and therefore, the photosensitive layer area 7*b*1 of the photosensitive drum 7 can be prevented from being injured during assembly.

(Charging Means)

The primary charging means 8 is one using the so-called contact charge method, and serves to cause an electrically conductive roller to bear against the photosensitive drum 7 and apply a voltage to this electrically conductive roller to thereby uniformly charge the surface of the photosensitive drum 7. This electrically conductive roller is rotated following the rotation of the photosensitive drum 7. A contact plate 8*b* is in contact with one end of the shaft 8*a* of the primary charging means 8, and a portion of the contact plate 8*b* is exposed to the process cartridge B (see FIGS. 5A and 5B). Accordingly, when the process cartridge B is mounted to the apparatus body, the contact plate 8*b* comes into contact with the contact on the body and the primary charging means 8 becomes electrically conducted.

(Cleaning Means)

The cleaning means 9 serves to remove and collect the residual toner (hereinafter referred to as the "waste toner") on the photosensitive drum after the toner image formed on the photosensitive drum 7 by each developing means of the developing unit 4 has been transferred to the recording medium P, and carries it into a toner container box 11 mounted in the cartridge. The cleaning means 9 is comprised of an elastic cleaning blade 9*a* for scraping off the waste toner on the photosensitive drum 7, a dip sheet 9*b* for preventing the scraped-off waste toner from overflowing toward the drum, an agitating member 9*c* for agitating the scraped-off waste toner, and a toner conveying screw 9*d* for conveying the waste toner collected by the agitating member 9*c* into the toner containing box 11, the toner conveying screw 9*d* being integrally incorporated in the cartridge frame member 10. Also, the lengthwisely opposite end portions of the cleaning blade 9*a* and dip sheet 9*b* are provided with seal members 9*e* for preventing the leakage of the waste toner from the end portions. The opposite end portions of the cleaning blade 9*a* and dip sheet 9*b* are urged against the photosensitive drum 7 by these seal members 9*e*.

(Dip Sheet)

Figure 12:
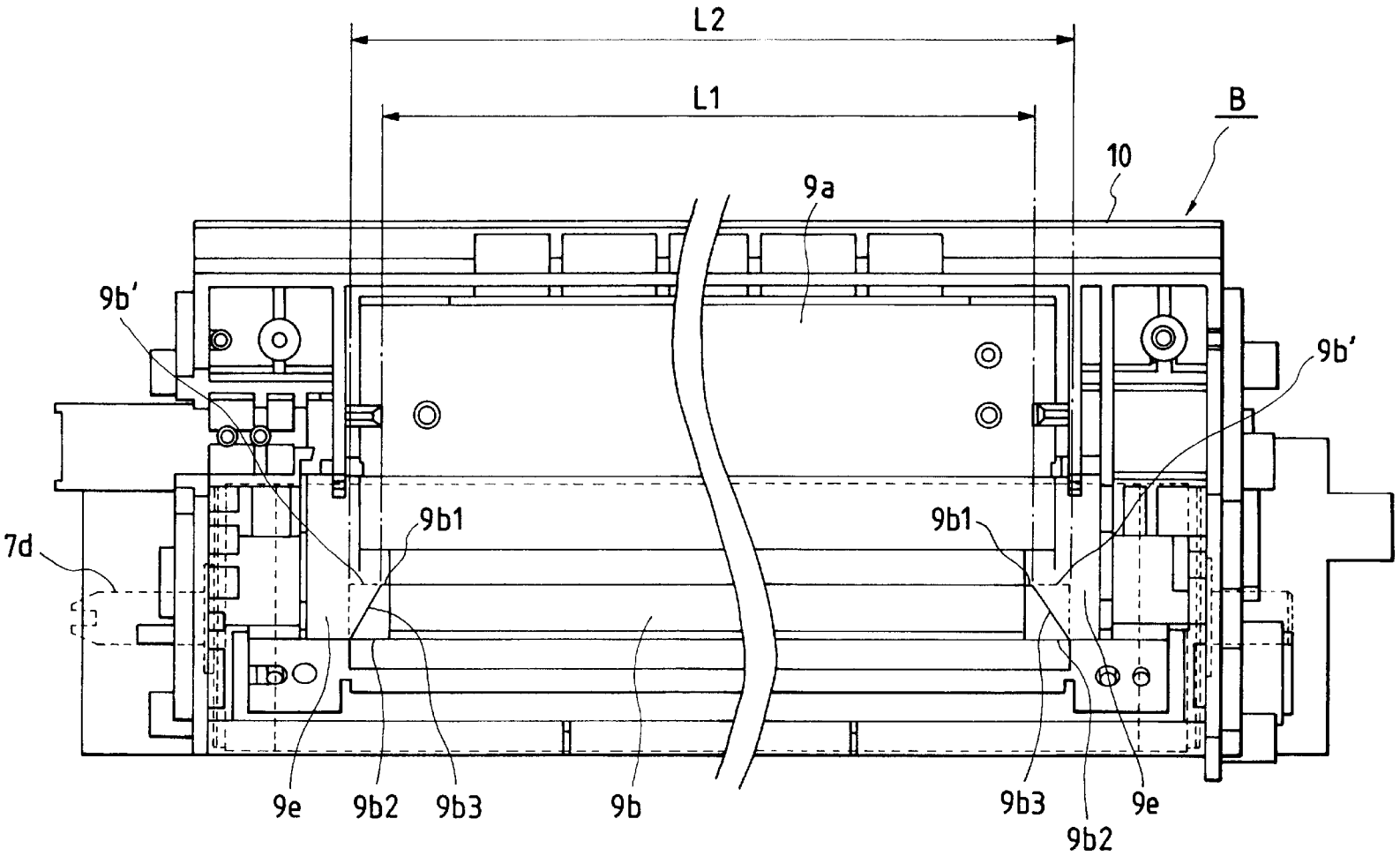
FIG. 12 is a schematic view showing the shape of a dip sheet in the lengthwise direction of the process cartridge.

The dip sheet 9*b*, as shown in FIG. 12, is formed into a shape in which the opposite end portions 9*b*3 thereof are obliquely cut so that the width $L_1$ of the fore end portion (adjacent to the cleaning blade 9*a*) 9*b*1 thereof may be smaller than the width $L_2$ of the root portion 9*b*2 thereof. Thus, the area of the opposite end portions 9*b*3 of the dip sheet 9*b* held between the photosensitive drum 7 and the seal members 9*e* becomes small as compared with a conventional dip sheet 9*b*' (the broken-line portion in FIG. 12). Accordingly, the area of the dip sheet 9*b* pulled with the rotation of the photosensitive drum 7 becomes small and therefore, the waving of the dip sheet 9*b* can be prevented and the leakage of the toner attributable to this waving can be prevented. Also, on the opposite end portions 9*b*3 of the dip sheet 9*b*, the root portion 9*b*2 is sufficiently greater in the amount of overlap with the seal members 9*e* than the fore end portion 9*b*1 and therefore, the toner does not leak from the portion of overlap between the dip sheet 9*b* and the seal members 9*e*.

(Toner Conveying Screw)

Figure 13:
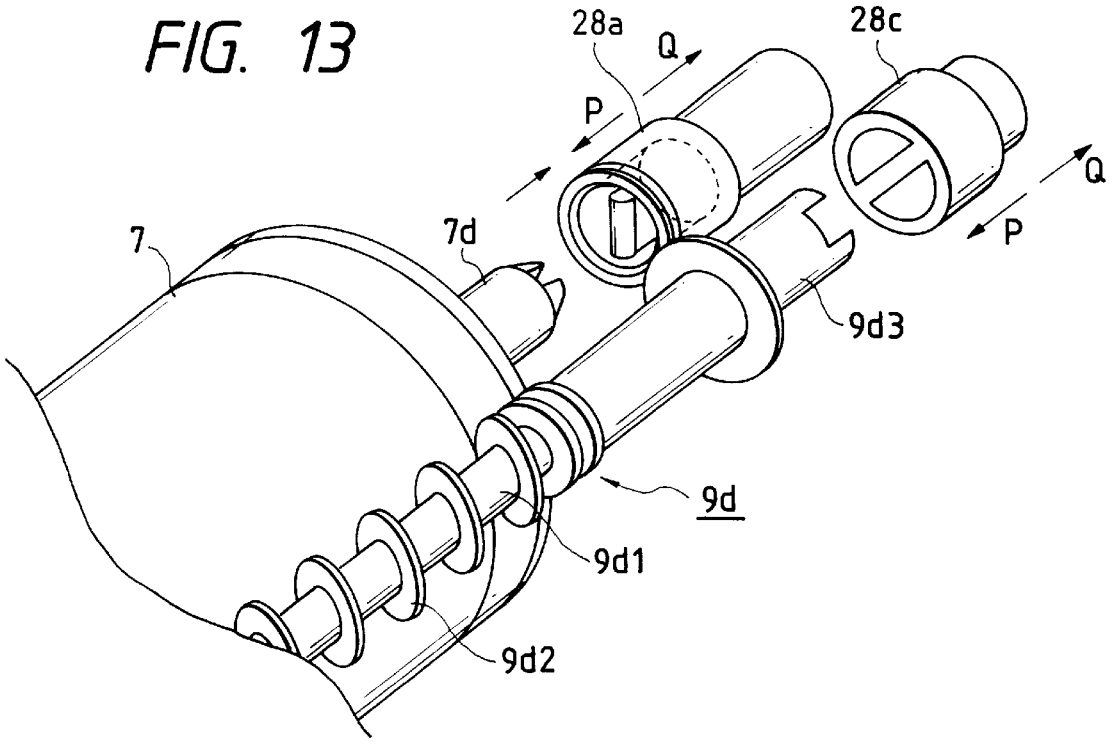
FIG. 13 is an enlarged perspective view of the connecting portion between the drive receiving portions of the photosensitive drum and a conveying screw and the drive shaft of a driving mechanism.

The toner conveying screw 9*d* has a spiral screw vane 9*d*2 around a screw shaft 9*d*1, which protrudes toward a lengthwise end more than at least the screw vane 9*d*2. The protruding portion 9*d*3 of this screw shaft 9*d*1, as shown in FIG. 13, is protrudedly provided on the same side as the tip-split shaft 7*d* of the photosensitive drum 7, and the tip end thereof is formed into a tip-split shape so as to be directly connected to the driving mechanism on the apparatus body side during the mounting of the cartridge. Further, as shown in FIG. 3, a screw driving gear 14*a* is mounted on the protruding portion 9*d*3, and this screw driving gear 14*a* is connected to an agitating drive gear 14*b* mounted on one end of the agitating member 9*c*, through an idler gear 14*c*. Accordingly, when the process cartridge B is inserted and mounted in the axial direction (the direction of an arrow in FIG. 13) of the photosensitive drum 7, the protruding portion 9*d*3 fits to a drive shaft 28*c* on the apparatus body in the same manner as the photosensitive drum 7, and the toner conveying screw 9*d* is connected to the driving mechanism on the apparatus body. When the drive shaft 28*c* is rotated, the toner conveying screw 9*d* is rotated and at the same time, the agitating member 9*c* is also rotated.

As described above, the protruding portion 9*d*3 which is the drive force receiving portion of the screw 9*d* and the tip-split shaft 7*d* which is the drive force receiving portion of the photosensitive drum 7 are provided discretely from each other and therefore unnecessary vibration is not transmitted from the screw to the photosensitive drum 7 and thus, the accuracy of rotation of the photosensitive drum 7 is improved.

Also, as in the present embodiment, the protruding portion 9*d*3 which is the drive force receiving portion of the toner conveying screw 9*d* is disposed on the same side as the tip-split shaft 7*d* which is the drive force receiving portion of the photosensitive drum 7 and the cartridge B is mounted in the axial direction (the direction of an arrow in FIG. 13) of the photosensitive drum 7, whereby the protruding portion 9*d*3 and the tip-split shaft 7*d* are connected to the drive shafts 28*a* and 28*c* of the driving mechanism on the apparatus body side and therefore, the mountability of the cartridge is improved.

Also, as previously described, the photosensitive drum 7 and the screw 9*d* in the process cartridge B receive a drive force from the body by the tip-split shaft 7*d* having a U-shaped groove and the protruding portion 9*d*3 also having a U-shaped groove, respectively (FIG. 13). When the process cartridge B is mounted in the body, the tip-split shaft 7*d* and the protruding portion 9*d*3 are coupled to the drive shaft 28*a* and drive shaft 28*c*, respectively, on the body side. However, when the process cartridge is mounted in the body, the meshing engagement between the drive shaft 28*a* and the tip-split shaft 7*d* and the meshing engagement between the drive shaft 28*c* and the protruding portion 9*d*3 do not always take place successfully. So, in the present embodiment, the drive shafts 28*a* and 28*c* are both biased to predetermined positions in the direction of arrow P by springs or the like. Thus, even if during the mounting of the process cartridge, the tip-split shaft 7*d* and the drive shaft 28*a* do not come into meshing engagement, the drive shaft 28*a* is pushed by the tip-split shaft 7*d* and is thereby retracted in the opposite direction of arrow Q and therefore, the process cartridge B can be inserted to a predetermined position.

The drive shaft 28*a* and the tip-split shaft 7*d* which have not come into meshing engagement with each other during the mounting of the process cartridge can be brought into meshing engagement with each other if for example, the drive shaft 28*a* is rotated during pre-processing (i.e., a process for making the surface potential of the photosensitive layer constant) before an image is formed on the photosensitive layer. Simultaneously with the meshing engagement, the drive shaft 28*a* is biased in the direction of arrow P by the spring and therefore, the photosensitive member begins to be rotated and thus, no hindrance is caused to the image forming operation. The drive shaft 28*c* is likewise retractable in the direction of arrow Q, and if the drive shaft 28*c* is rotated, the drive shaft 28*c* and the protruding portion 9*d*3 will come into meshing engagement with each other.

If as described above, the drive shafts 28*a* and 28*c* are elastically biased in the direction of arrow P, the mounting of the process cartridge can be effected more easily and improvements in the mountability of the process cartridge and the accuracy of rotation of the photosensitive member can be made compatible. Of course, it may be one of the drive shafts 28*a* and 28*c* that is elastically biased.

Figure 14:
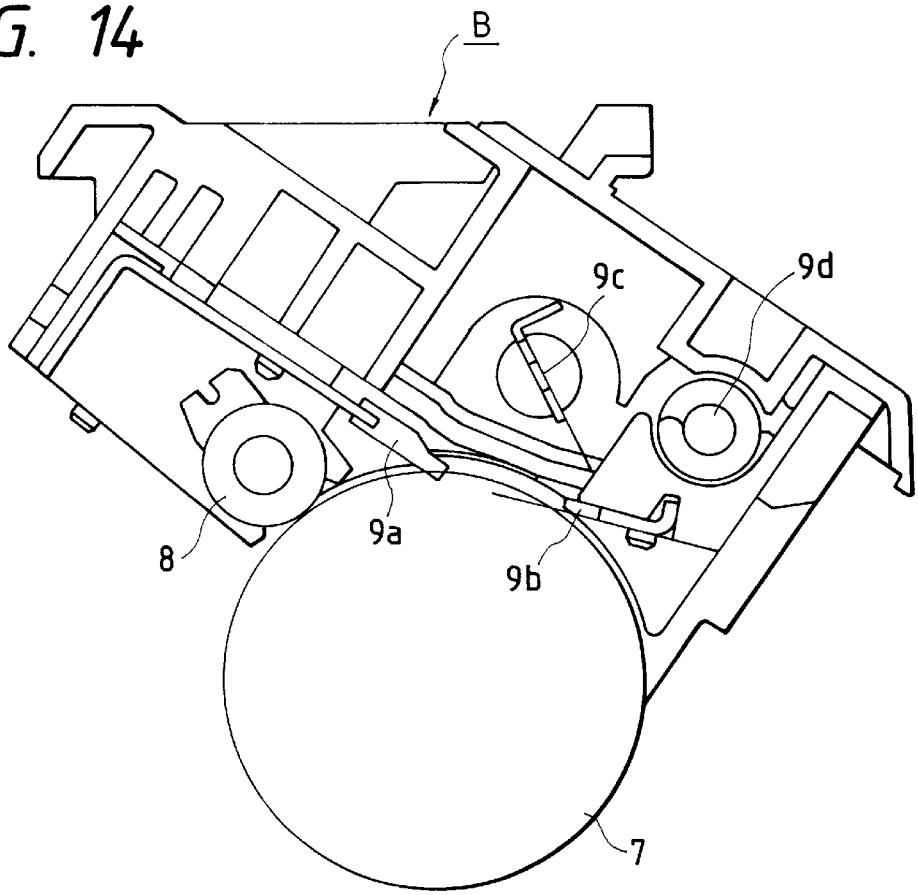
FIG. 14 is a schematic cross-sectional view of the cartridge showing the arrangement relation between the conveying screw and the photosensitive drum.

Also, in the present embodiment, as shown in FIG. 14, the toner conveying screw 9*d* is disposed in the cartridge B above the photosensitive drum 7. Design is thus made such that the waste toner scraped off by the cleaning blade 9*a* is agitated up to the position of the toner conveying screw 9*a* by the agitating member 9*c*. Thus, when the waste toner is agitated up by the agitating member 9*c*, the waste toner remains in a small amount on the portion of contact between the cleaning blade 9*a* and the photosensitive drum 7 and therefore, the lubrication of the cleaning blade 9*a* and the photosensitive drum 7 is kept and the tear-off of the cleaning blade 9*a* due to its long-period use can be prevented.

(Cartridge Frame Member)

The cartridge frame member 10 incorporates the photosensitive drum 7, the primary charging means 8 and the cleaning means 9 integrally therein, and permits the waste toner containing box 11 to be removably mounted thereon.

(Cover Members)

Figure 15:
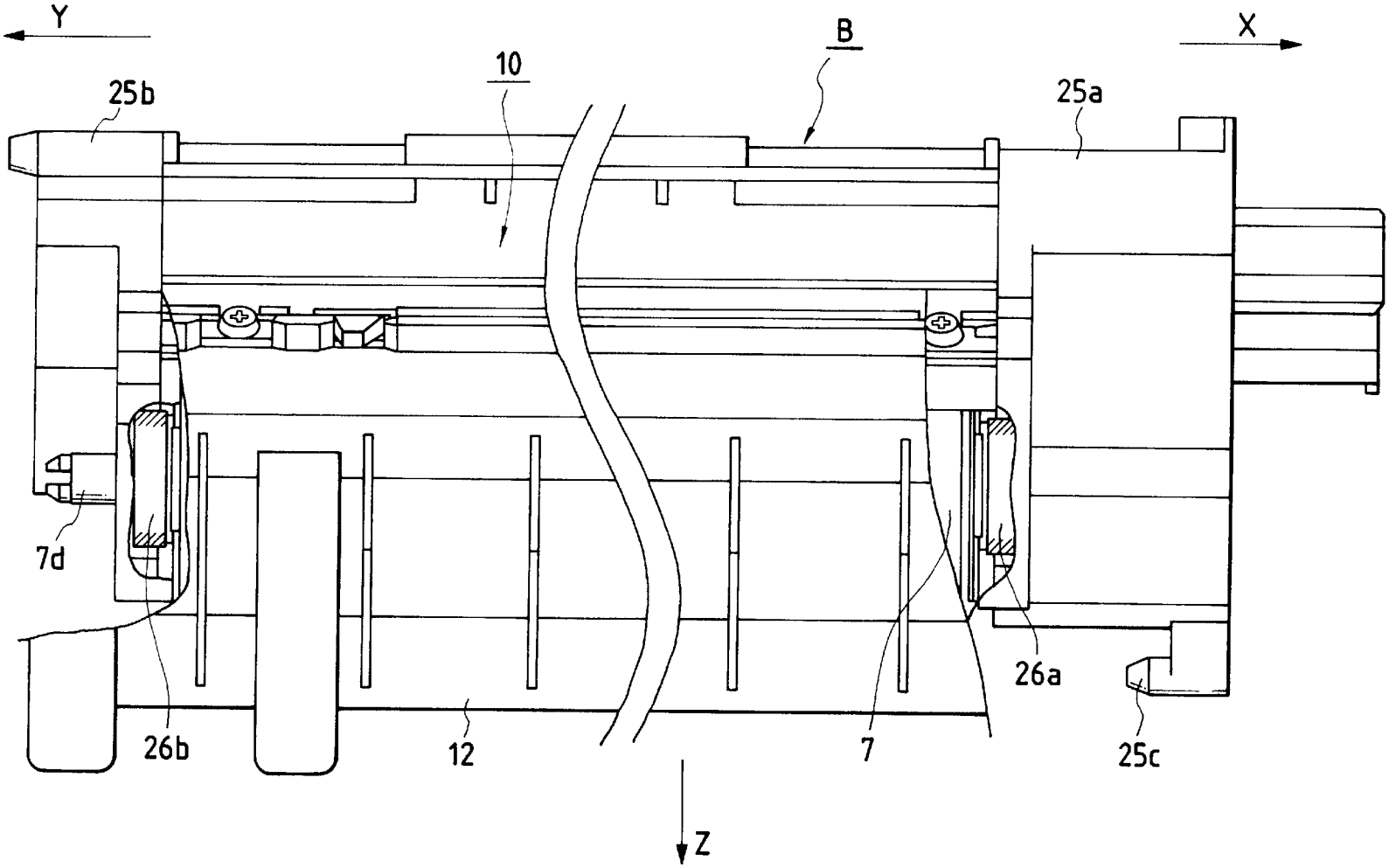
FIG. 15 is a schematic side view showing the relation between the electrophotographic photosensitive member in the process cartridge and a cover member.

The cartridge frame member 10, as shown in FIG. 15, has cover members 25*a* and 25*b* for positioning and supporting the photosensitive drum 7 on the lengthwisely opposite ends thereof. Specifically, the cover members 25*a* and 25*b* are designed to position and support the photosensitive drum 7 with the outer peripheral portions of bearing members 26 rotatably supporting the photosensitive drum 7 as a reference. Also, second positioning portions for positioning the cartridge B relative to the printer body are integrally formed on the cover members 25*a* and 25*b* made of resin. That is, a positioning pin 25*c* to be inserted into a positioning hole (not shown) on the printer body is projectedly provided on one cover member 25*a* in the direction of insertion of the cartridge, and a positioning hole 25*d* into which a positioning pin (not shown) on the printer body is to be inserted is formed in the other cover member 25*b* in the direction of insertion of the cartridge. Consequently, when the process cartridge B is mounted in the printer body, the positioning pin 25*c* is inserted into the positioning hole on the printer body side and at the same time, the positioning pin on the printer body side is inserted into the positioning hole 25*d*, whereby the process cartridge B is positioned and mounted in the printer body.

Accordingly, a supporting portion (first positioning portion) for supporting the photosensitive drum 7 with the outer peripheral portion of the bearing members 26 of the drum 7 as a reference and a positioning portion (second positioning portion) to be coupled to the positioning portion on the printer body are accurately formed on the cover members 25*a* and 25*b* of the cartridge frame member 10, whereby the process cartridge B can be highly accurately positioned relative to the printer body, that is, the photosensitive drum 7 can be highly accurately positioned relative to the printer body, and good images can be obtained. Also, simply by pulling out the cover member 25*a* in the direction of arrow X with a bearing 26*a* and the cover member 25*b* in the direction of arrow Y with a bearing 26*b*, the photosensitive drum 7 becomes removable in the direction of arrow Z and thus, the cartridge B is designed to be recycled easily.

Also, the cartridge frame member 10 has on the outer side of an end wall 10*c*1 on this side as viewed in FIG. 3 a protruded wall 10*c*2 in parallel to the end wall 10*c*1, and the edges of the end wall 10*c*1 and the protruded wall 10*c*2 are connected together by a peripheral wall 10*c*3 and the interior thereof is a hollow space. On the front side of the protruded wall 10*c*2, a handle 10*d* for taking out the cartridge is integrally protrudedly formed in such a manner as to surround a discharge cylinder 10*e*. These together constitute the cover member 25*a* of the cartridge frame member 10.

(Scattered Toner Preventing Member)

Figure 16:
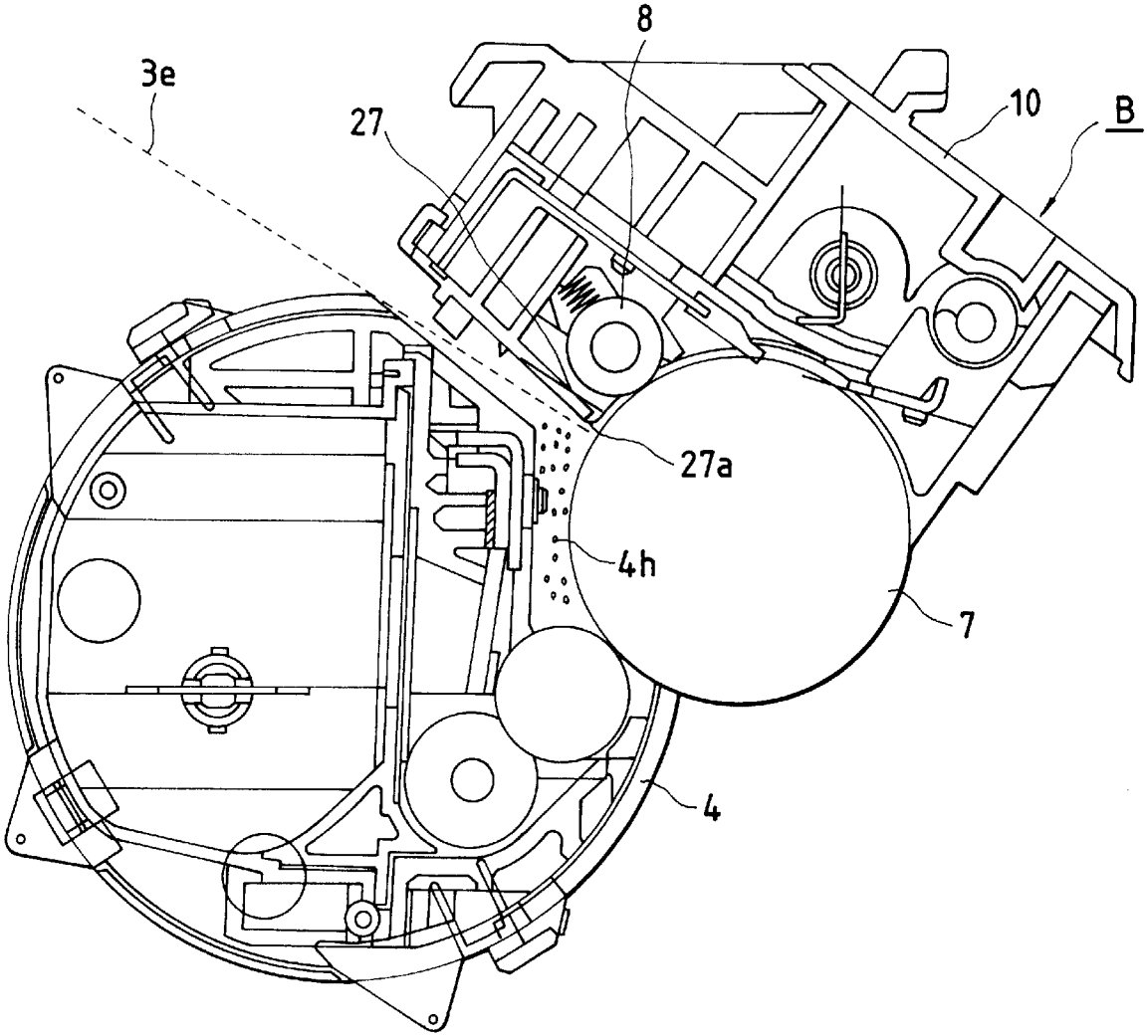
FIG. 16 is a schematic cross-sectional view of the process cartridge and a developing unit showing the state of disposition of a film member.
Figure 17:
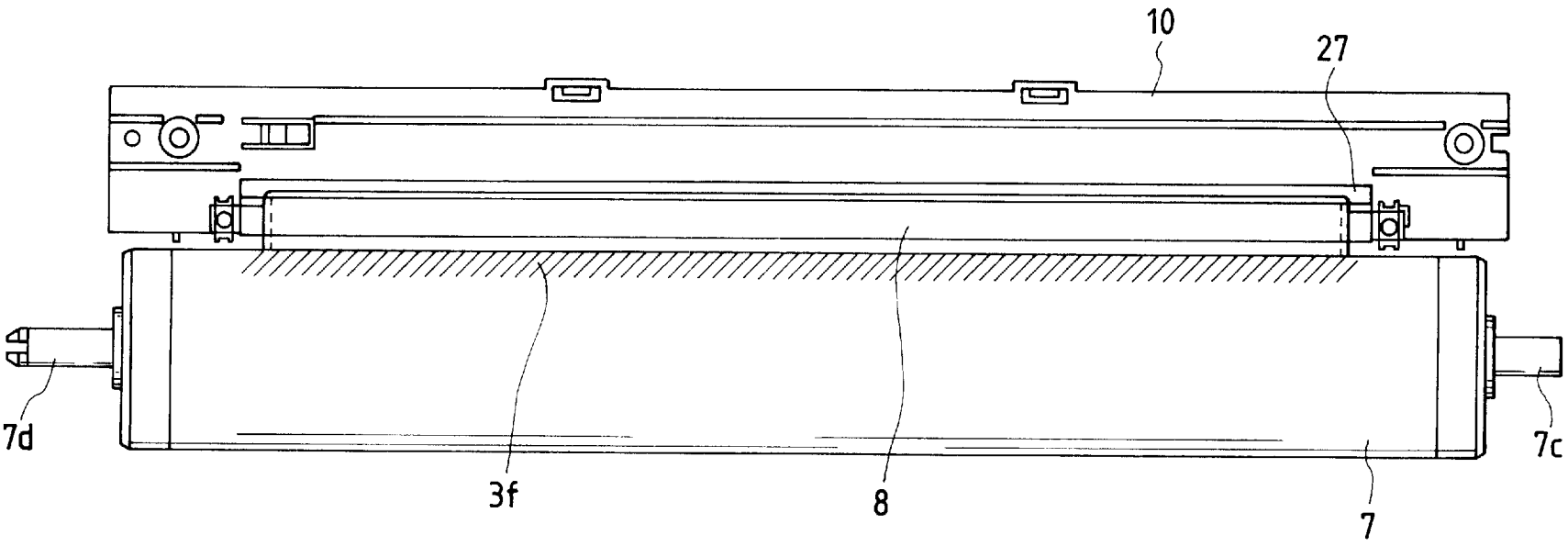
FIG. 17 is a schematic side view showing the state of disposition of the film member in the lengthwise direction of the process cartridge.

Also, the cartridge frame member 10 has a film member 27 as a scattered toner preventing member for preventing the toner scattered from the developing unit 4 from adhering to the primary charging roller 8. This film member 27, as shown in FIGS. 16 and 17, is provided in the lengthwise direction of the primary charging roller 8 on that side of the charging roller 8 incorporated in the cartridge frame member 10 which is adjacent to the developing unit 4, so as to cover the charging roller 8. Accordingly, even if there is toner 4*h* scattered from the developing unit 4, it is interrupted by the film member 27 and therefore, the scattered toner 4*h* does not adhere to the primary charging roller 8.

If here, design is made so as to cover the primary charging roller, for example, with the cartridge frame member instead of the film member, the gap between the cartridge frame member and the developing unit will become narrow, that is, a gap 27*a* through which a laser beam 3*e* applied from the scanner to the photosensitive drum 7 passes will become narrow, and there will be the undesirable possibility of the cartridge frame member 10 intercepting the laser beam 3*e* due to the tolerance of each part and the vibration or the like during the operation of the cartridge and the printer body. So, this portion is formed by the film member 27, whereby in addition to the above-described effect, the gap 27*a* can be sufficiently secured, and the laser beam 3*e* from the scanner is prevented from being intercepted. Also, the film member 27, as shown in FIG. 17, is formed longer than the application range of the laser beam in the main scanning direction. Thereby, the interception of the laser beam 3*e* from the scanner can be prevented more reliably.

In the present embodiment, polyethylene terephthalate having a thickness of the order of 50 $\mu$m to 300 $\mu$m is used as the film member 27, but this is not restrictive.

(Guide Portion)

Figure 18:
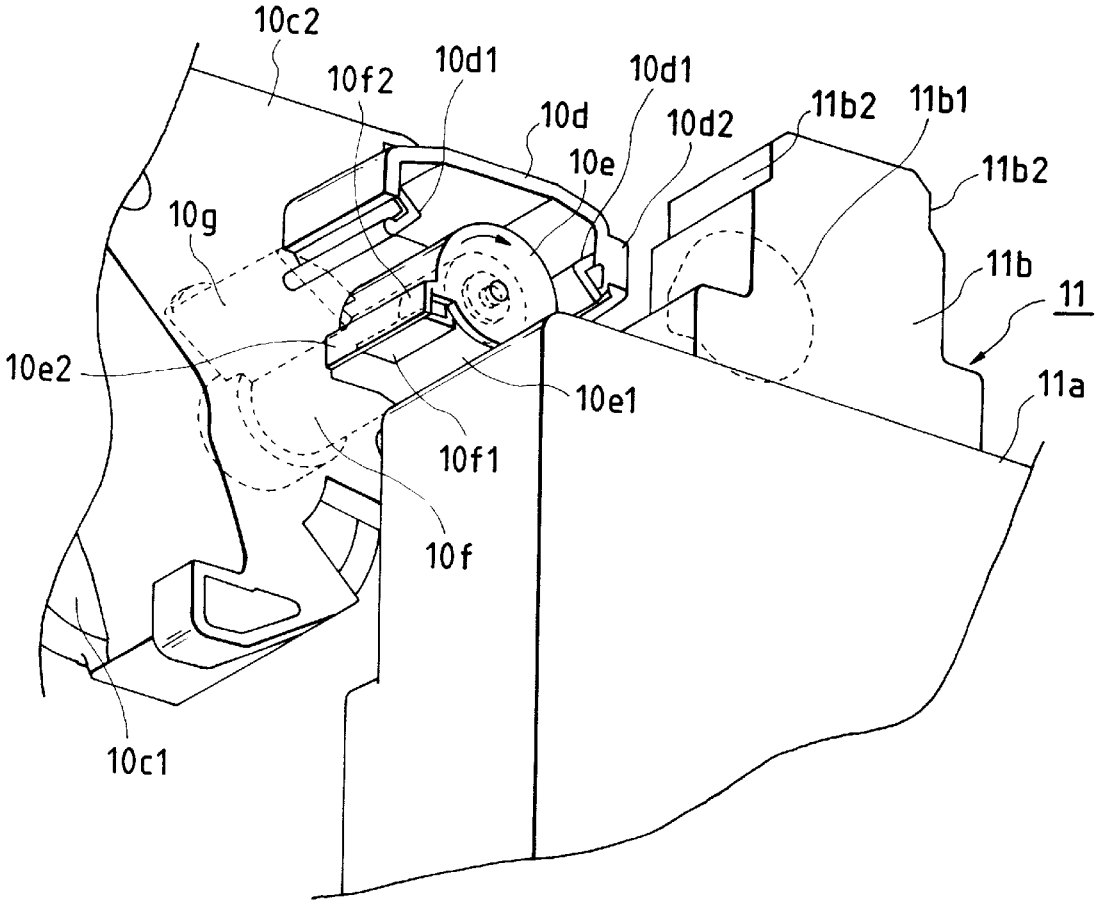
FIG. 18 is a perspective view of the mounting guide portion of a waste toner containing box.
Figure 19:
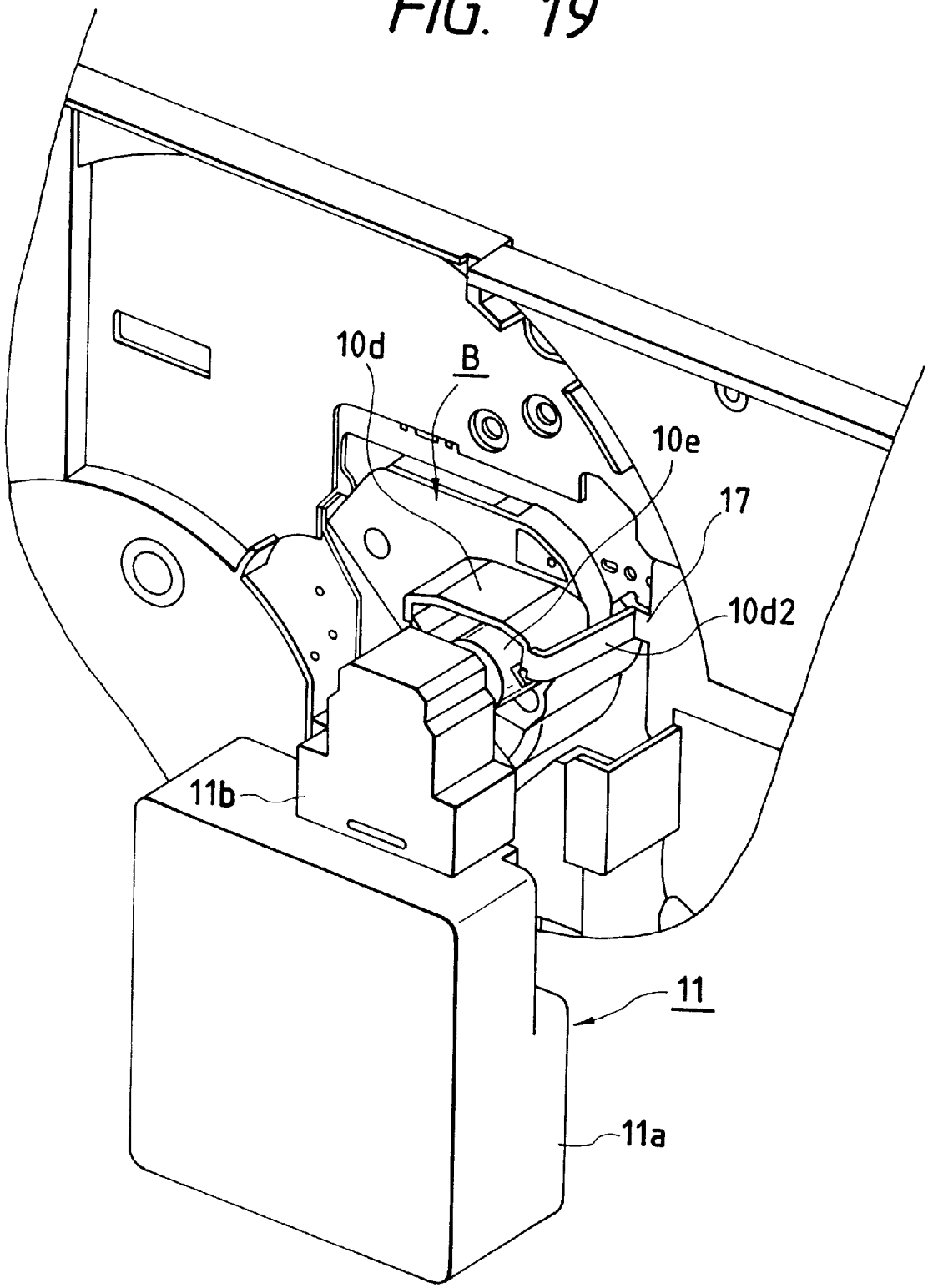
FIG. 19 is a perspective view of a cartridge lock mechanism.

Also, on the lower end edge of the handle 10*d* formed integrally with the cartridge frame member 10, as shown in FIGS. 18 and 19, there is axially integrally formed a guide portion 10*d*1 for guiding and supporting the waste toner containing box 11 during the mounting and dismounting of the waste toner containing box 11. The waste toner containing box 11 has a stepped waste toner receiving portion 11*b* removably mounted on the upper portion of a waste toner containing portion 11*a*, and the waste toner receiving portion 11*b* is formed with a waste toner fall port 11*b*1 into which the discharge cylinder 10*e* of the cartridge B comes. The waste toner containing box 11 may be mounted with the mounting surface 11*b*2 thereof guided along the guide portion 10*d*1 formed on the handle 10*d*. Here, the difference between the outer diameter of the discharge cylinder 10*e* and the inner diameter of the waste toner fall port 11*b*1 is set to a minute value, and the coupling portion therebetween is substantially covered with the handle 10*d* having the guide portion 10*d*1 and therefore, the scattering or the like of toner can be suppressed and the interior of the apparatus can be prevented from being contaminated.

(Lock Paul)

A resilient lock pawl 10*d*2 for locking and unlocking the process cartridge B relative to the apparatus body during the mounting and dismounting of the cartridge is formed integrally with the side wall of the handle 10*d*. This lock pawl 10*d*2 comes into engagement with an engagement portion 17 on the apparatus body by its resiliency during the mounting of the cartridge and thus, the process cartridge B becomes locked relative to the apparatus body. Also, during the removal of the cartridge, a user grasps the handle 10*d* to thereby grasp the lock pawl 10*d*2 at the same time and therefore, the engagement thereof with the engagement portion 17 on the apparatus body is released and the process cartridge B becomes capable of being pulled out of the apparatus body. By this lock pawl 10*d*2, the locking/unlocking during the mounting and dismounting of the cartridge becomes easy and the operability is improved and the construction of the cartridge lock mechanism becomes simple and a reduction in cost can be achieved.

(Toner Discharge Cylinder)

Figure 20:
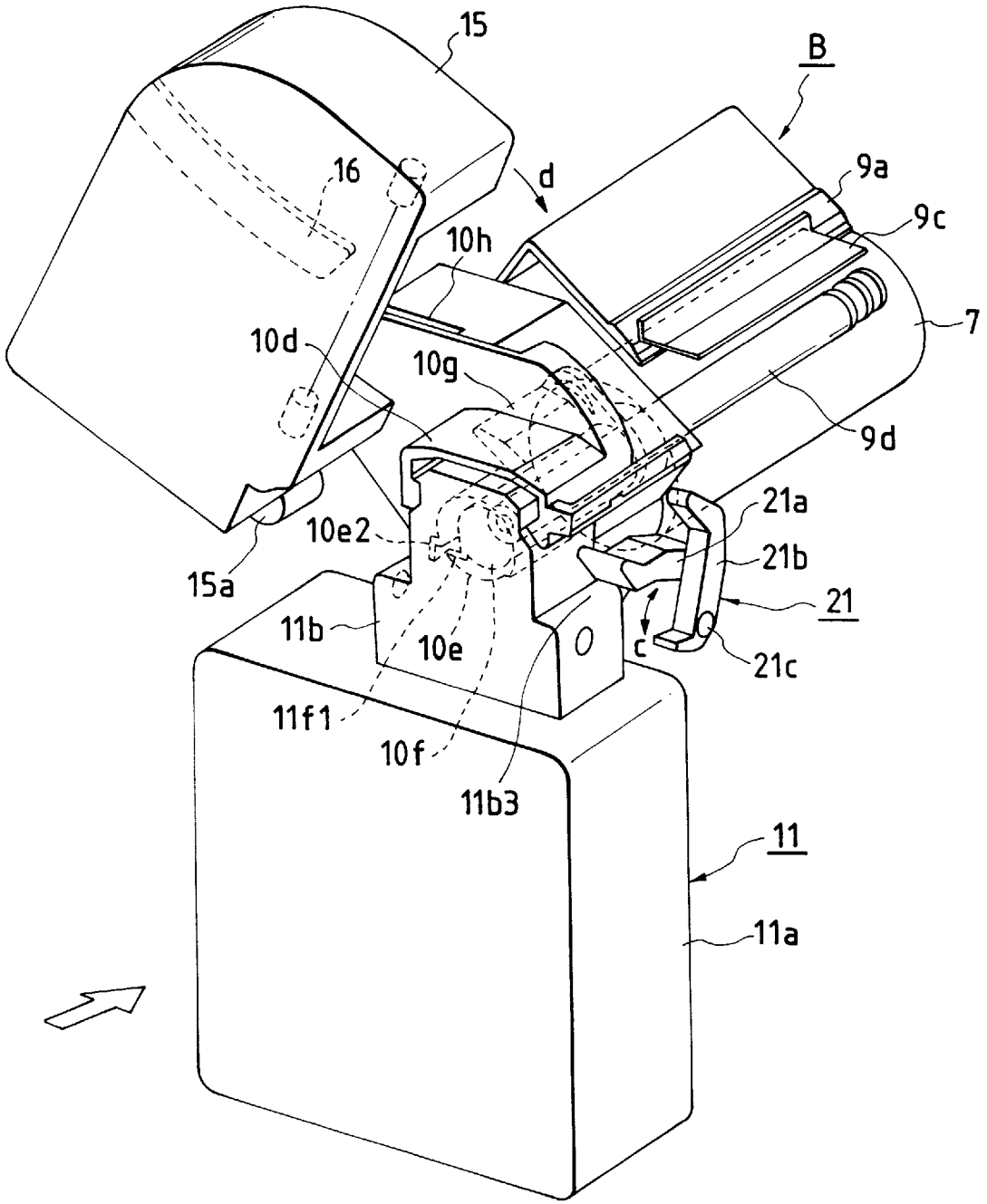
FIG. 20 is a perspective view showing the relations among the cartridge, the waste toner containing box and a holding member.

Also, as shown in FIG. 20 in the handle 10*d* for taking out the cartridge, the discharge cylinder 10*e* protrudes outwardly from a protruding wall 10*c*2. The discharge cylinder 10*e* is of a cut-away cylindrical shape and has an opening 10*e*1 in the lower portion thereof, and on the edge portion of the opening 10*e*1, a protruding edge 10*e*2 is provided parallel to the axial direction of the waste toner conveying screw 9*d* and the tip and thereof is made to depend downwardly.

A cylindrical shutter 10*f* is rotatably fitted in the discharge cylinder 10*e*. The shutter 10*f* is biased in the direction of arrow by biasing means not shown, and is provided with a waste toner fall preventing wall 10*f*1 extending in the tangential direction of this cylinder, and a waste toner discharge port 10*f*2 formed downstream of the preventing wall 10*f*1 with respect to the direction of bias. Usually, the shutter 10*f* is in a state in which the upper surface of the waste toner fall preventing wall 10*f*1 strikes against the protruding edge 10*e*2 of the discharge cylinder 10*e* and is stopped by the biasing force of the biasing means and the waste toner discharge port 10*f*2 is surrounded and closed in the discharge cylinder 10*e*.

Also, the shutter 10*f* extends in a completely hollow cylindrical shape from the protruding wall 10*c*2 to an end wall 10*c*1, and is rotatably supported by a bearing (not shown) provided on the end wall 10*c*1. The threaded vane 9*d*2 of the toner conveying screw 9*d* is in this shutter 10*f* (see FIG. 1). Also between the end wall 10*c*1 and the protruding wall 10*c*2, a shutter releasing lever 10*g* is integrally and protrudedly formed on the outer periphery of the shutter 10*f*, and as shown in FIG. 20, the shutter releasing lever 10*g* is disposed so as to lie below a gap 10*h*. A lever 16 provided on a holding member 15 on the apparatus body comes into this gap 10*h* and depresses the shutter releasing lever 10*g* so that the shutter 10*f* may rotate against a biasing force and the waste toner discharge port 10*f*2 may be opened.

The holding member 15 is for holding the waste toner containing box 11 in the discharge cylinder 10*e* which is a waste toner discharge portion from the cleaning means, and is supported on the image forming apparatus body for pivotal movement about a support shaft 15*a*.

(Mounting of the Waste Toner Containing Box)

Accordingly, the mounting of the waste toner containing box 11 to the process cartridge B is done with the mounting surface 11*b*2 of the waste toner containing box 11 guided along a guide portion 10*d*1 formed integrally with the handle 10*d*, and then the holding member 15 is pivotally moved to a holding position, whereby the shutter 10*f* in the discharge cylinder 10*e* is rotated and the waste toner discharge port 10*f*2 is opened in the waste toner containing box 11 and at the same time is held by the holding member 15. Thereby, the waste toner containing box 11 does not inadvertently come off the process cartridge B and the scattering or the like of the toner is also prevented.

The waste toner containing box 11 is in a state in which it has been removed from the process cartridge B, and is adapted to be mounted as described above after the process cartridge B has been mounted to the apparatus body. When the waste toner containing box 11 becomes full of waste toner, it is removed and replaced with another one.

Now, in the image forming apparatus body, as shown in FIG. 20, there is provided a preventing member 21 comprised of two arms 21*a* and 21*b* pivotally movable about a support shaft 21*c*. This preventing member 21 is biased in the direction of arrow c in FIG. 20 by biasing means (not shown) such as a torsion spring, and when the waste toner containing box 11 is not mounted, the preventing member 21 keeps a state in which one arm 21*a* falls down horizontally and the other arm 21*b* erects vertically. Accordingly, when the waste toner containing box 11 is not mounted, the arms 21*a* and 21*b* of the preventing member 21 keep the above-described state, and when in this state, an attempt is made to pivotally move the holding member 15 about a support shaft 15*a* in the direction of arrow d in FIG. 20 to close it, the wall surface 15*b* of the holding member 15 is abutted against the tip end portion of the vertically erecting arm 21*b* and therefore, it is impossible to close the holding member 15.

However, as previously described, when the waste toner containing box 11 is mounted as shown in FIG. 20, one arm 21*a* of the preventing member 21 is abutted against the end portion (shoulder) of the waste toner receiving portion 11*b* of the waste toner containing box 11 and pivotally moves in the direction of arrow c in FIG. 20 and therefore, the other arm 21*b* also pivotally moves in the same direction with it and retracts. Therefore, in a state in which the waste toner containing box 11 has been mounted, the interference with the arm 21*b* of the holding member 15 is avoided and the holding member 15 can be completely closed.

(Protective Cover)

The protective cover 12, as shown in FIGS. 4 and 5, serves to protect the exposed portion of the photosensitive drum 7 in the cartridge, and is removably supported on the process cartridge B. That is, the protective cover 12 is supported in a state in which guide rails 12*a* and 12*b* provided in the lengthwise direction of the upper end edge thereof are slidable in the lengthwise direction (the axial direction) along guide grooves 10*i* and 10*j* formed in the cartridge frame member 10. Thus, the process cartridge B can be slid in the lengthwise direction thereof along the guide rails 12*a* and 12*b* of the protective cover 12, and the mounting thereof into the apparatus body can be done smoothly and easily. Also, the cartridge B can be inserted while the uninserted portion of the photosensitive drum 7 is always covered with the protective cover 12, and at the same time, the protective cover 12 can be taken out in a direction opposite to the direction of insertion.

Figure 21:
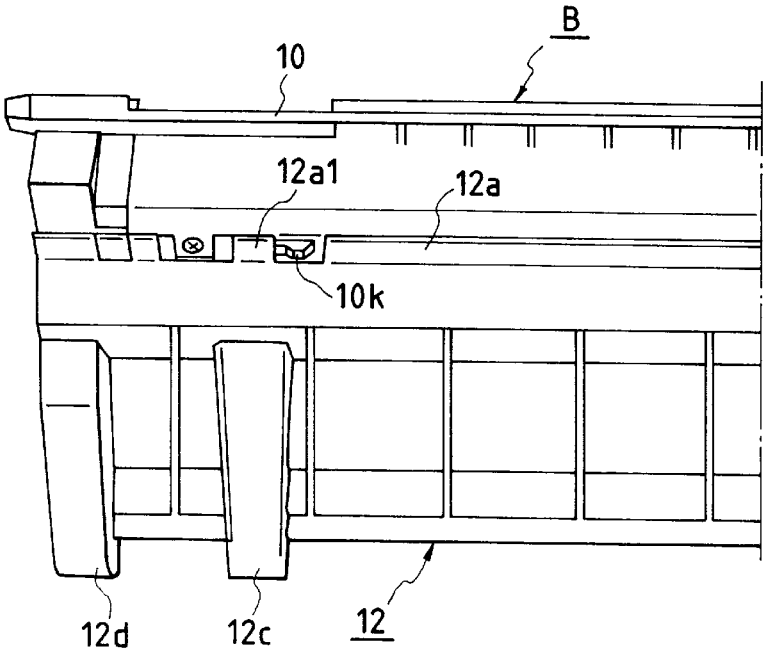
FIG. 21 is an enlarged view of the engagement portions of a protective cover and the cartridge.
Figure 22:
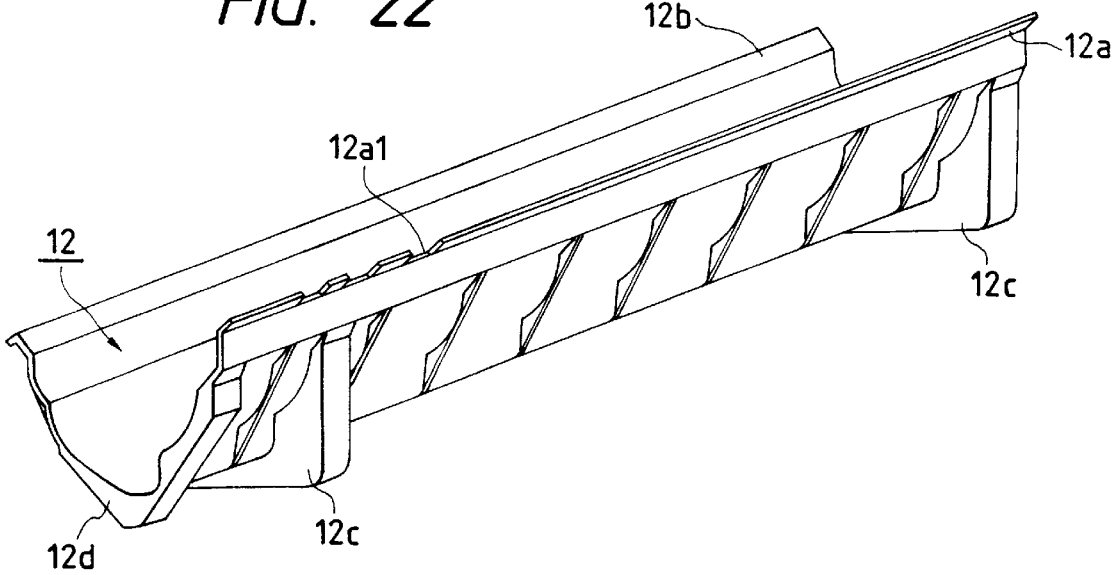
FIG. 22 is a perspective view of the protective cover.

Also, as shown in FIGS. 21 and 22, a lock portion 12*a*1 is provided on a portion of the guide rail 12*a* of the protective cover 12, and a resilient lock lever 10*k* is provided at the same location as the lock portion 12*a*1 but on that side adjacent to the cartridge frame member 10. These two are adapted to be engaged with each other in a state in which the protective cover 12 completely protects the photosensitive drum 7 in the process cartridge B. Design is made such that during the mounting of the cartridge, the process cartridge B is slid into the apparatus body along the guide rails 12*a* and 12*b* of the protective cover 12, whereby the resilient lock lever 10*k* is pushed into the cartridge frame member 10 by the guide rail 12*a* of the protective cover 12 and the above-mentioned engagement is released. Accordingly, the protective cover 12 can be prevented from coming off the cartridge B when not mounted and the photosensitive drum 7 can be prevented from being injured and at the same time, the engagement between the protective cover 12 and the cartridge B is easily released by the cartridge mounting operation and therefore, the operability is not spoiled.

Further, legs 12*c* which can be installed on a desk or the like are formed integrally with the protective cover 12 so that the process cartridge B before mounted in the apparatus body can be stably kept in custody.

Also, a fitting convex portion 12*d* adapted to fit in a fitting concave portion (not shown) on the apparatus body during the mounting of the cartridge is formed integrally on one end of the protective cover 12 in the lengthwise direction thereof (the end in the direction of insertion of the cartridge). The fitting concave portion (not shown) on the apparatus body has such an inner shape as to fit to the outer shape of the fitting convex portion 12*d*, and is provided on the front side plate of the apparatus body with a sufficient length capable of supporting the protective cover 12 during the mounting of the cartridge. Thus, the protective cover 12 can be easily fixed at an accurate location in the apparatus body and the process cartridge B can be smoothly inserted into the image forming apparatus body.

The above-described protective cover 12 can be easily removed simply by the operation of mounting the process cartridge B into the apparatus body and further, there is no fear that a hand inadvertently touches the surface of the photosensitive drum 7 or injures the latter and therefore, the operability is excellent and good images can be provided.

(Mounting of the Cartridge)

Figure 23:
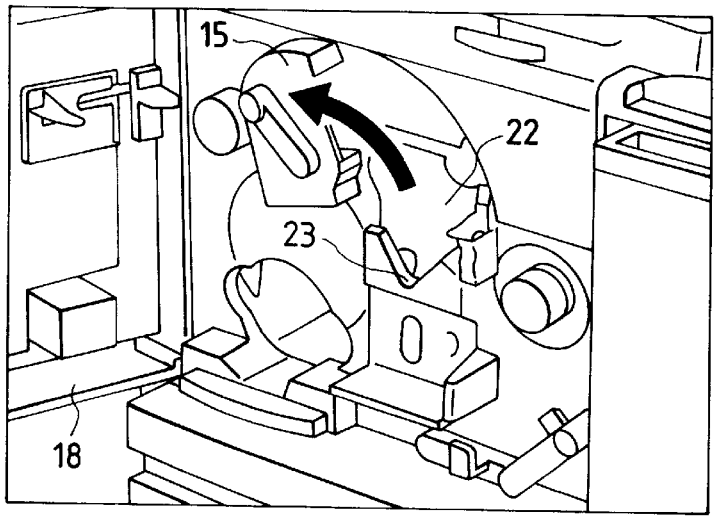
FIG. 23 is a schematic illustration showing the mounted state of the process cartridge.
Figure 24:
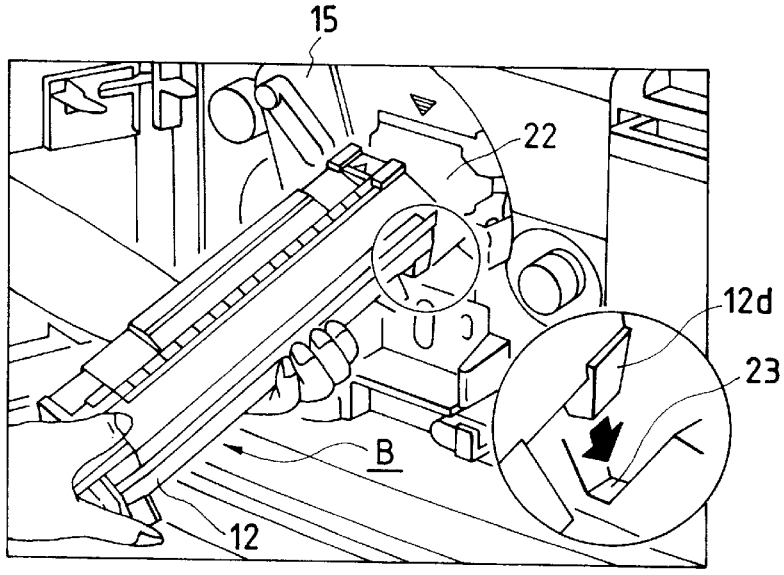
FIG. 24 is a schematic illustration showing the mounted state of the process cartridge.
Figure 25:
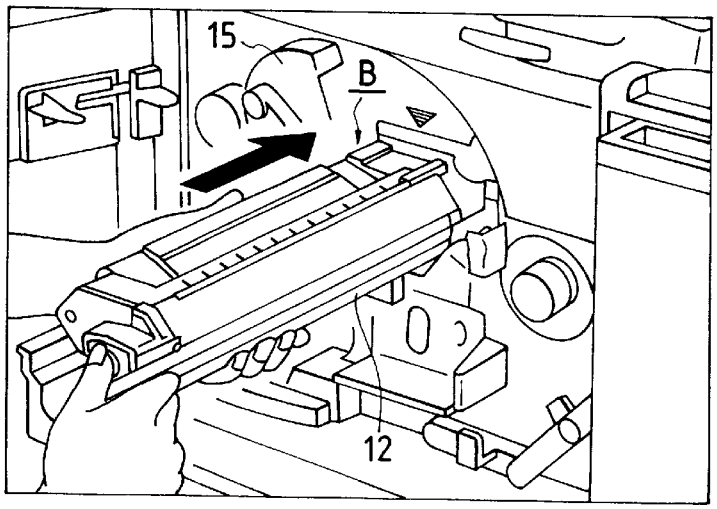
FIG. 25 is a schematic illustration showing the mounted state of the process cartridge.
Figure 26:
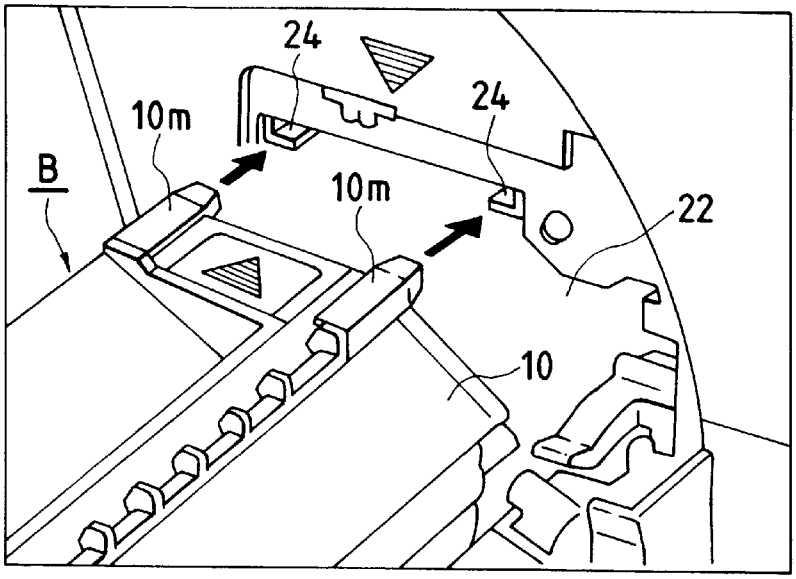
FIG. 26 is a schematic illustration showing the mounted state of the process cartridge.
Figure 27:
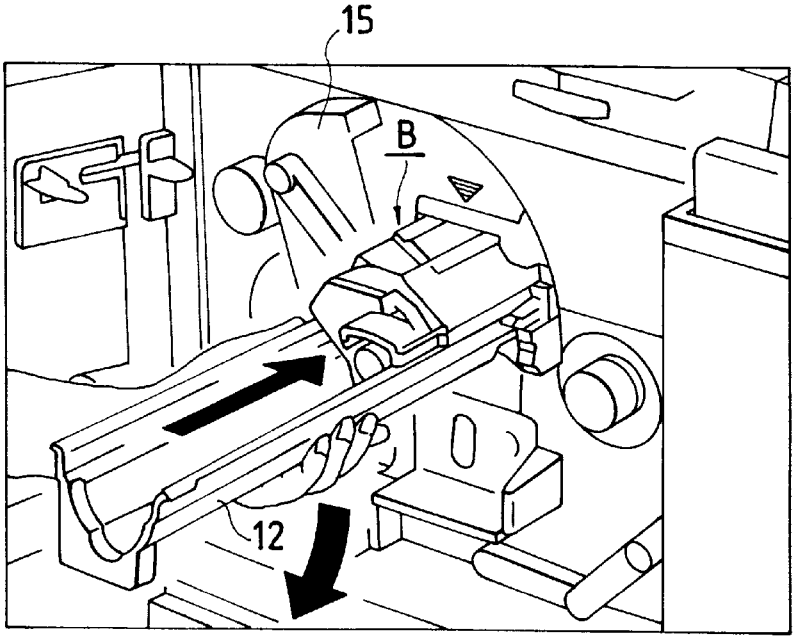
FIG. 27 is a schematic illustration showing the mounted state of the process cartridge.

The mounting of the process cartridge B having mounted thereon the protective cover 12 as described above into the image forming apparatus body is effected by the procedures as shown in FIGS. 23 to 27. First, as shown in FIG. 23, the operable-closable cover 18 on the front face of the apparatus body is opened, whereafter the holding member 15 is moved to its retracted position and a cartridge insertion port 22 is opened. The fitting convex portion 12*d* of the protective cover 12 is fitted into a fitting concave portion 23 provided in the edge portion of this cartridge insertion port 22 (see FIG. 24), and the process cartridge B is inserted into the apparatus body along the guide rails 12*a* and 12*b* of the protective cover 12 fixed by this fitting (see FIG. 25). At this time, the engagement between the lock portion 12*a*1 of the protective cover 12 and the lock lever 10*k* on the cartridge is released and further, a guide projection 10*m* provided on the upper portion of the cartridge frame member 10 slidably comes into engagement with a guide rail 24 provided in the apparatus body (see FIG. 26). Accordingly, the process cartridge B inserted into the apparatus body, as shown in FIG. 27, is guided by the guide rails 12*a* and 12*b* of the protective cover 12 and the guide rail 24 in the apparatus body and is introduced into the apparatus body.

When the process cartridge B is further inserted, a positioning pin 25*c* and a positioning hole 25*d* on the cartridge side fit to a positioning hole and a positioning pin (not shown) on the apparatus body and at the same time, the lock pawl 10*d*2 on the cartridge side comes into engagement with the engagement portion 17 on the apparatus body, whereby the positioning and mounting of the process cartridge B are done. The protective cover 12 comes off the process cartridge B in such a form as to be left outside the apparatus body by the process cartridge B being inserted into the apparatus body. As previously described, the waste toner containing box 11 is mounted on the process cartridge B, whereby there is brought about a state in which image formation can be started.

Figure 28:
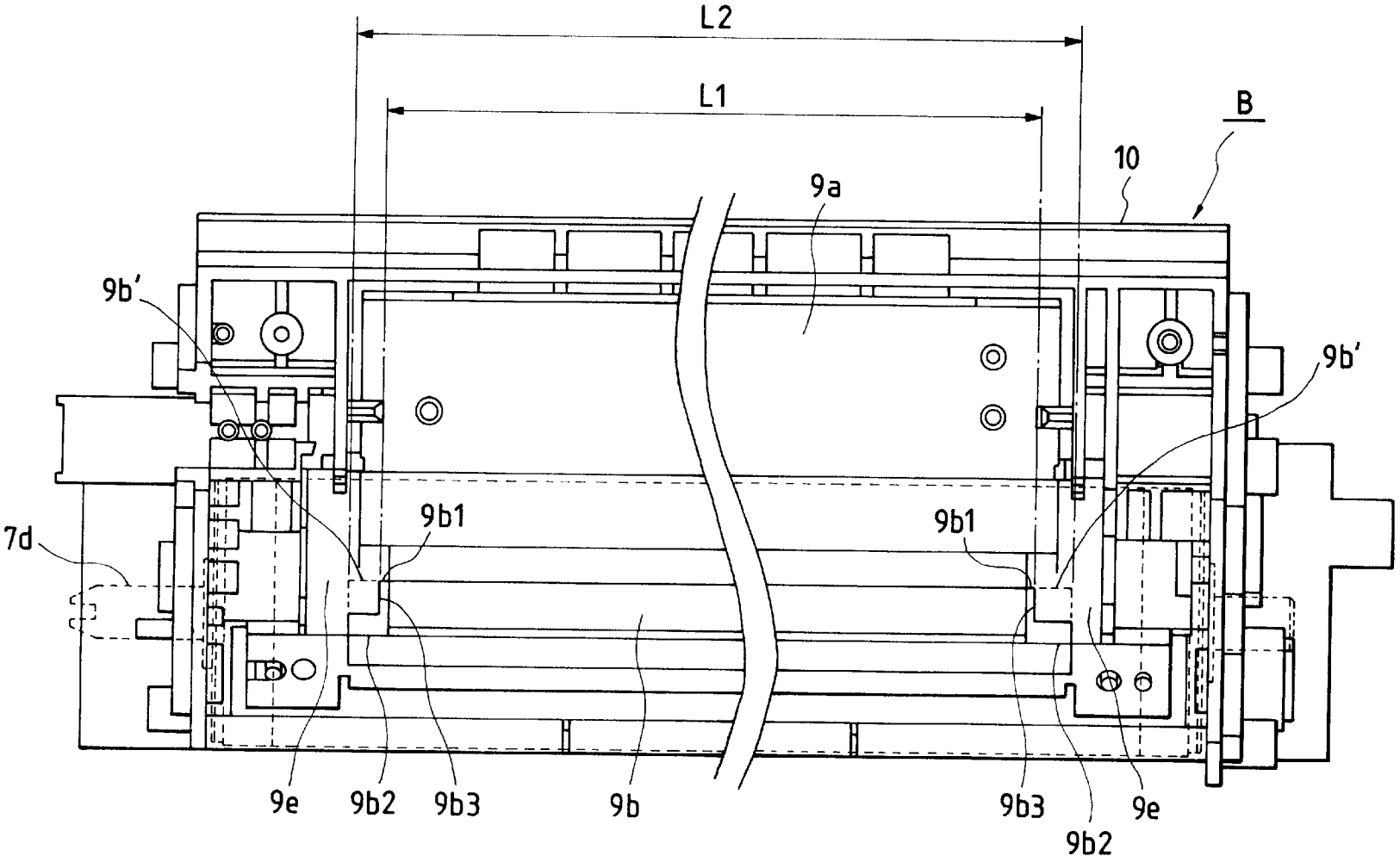
FIG. 28 is a schematic view showing another shape of the dip sheet in the lengthwise direction of the process cartridge.

While in the above-described embodiment, there has been exemplarily shown a construction in which as shown in FIG. 12, the opposite end portions 9*b*3 of the dip sheet 9*b* are obliquely cut to make the area of the opposite end portions 9*b*3 of the dip sheet 9*b* sandwiched between the photosensitive drum 7 and the seal member 9*e* small, those portions of the opposite end portions 9*b*3 of the dip sheet 9*b* which overlap the seal member 9*e* may be cut away as shown, for example, in FIG. 28. Again by this, the area of the dip sheet 9*b* pulled by the rotation of the photosensitive drum 7 becomes small and therefore, the waving of the dip sheet 9*b* can be prevented and the leakage of the toner attributable to such waving can be prevented. Also, on the opposite end portions 9*b*3 of the dip sheet 9*b*, the root portions 9*b*2 are sufficiently greater in the amount of overlap with the seal member 9*e* than the end portions 9*b*1 and therefore, toner does not leak from the portion of overlap between the dip sheet 9*b* and the seal member 9*e*.

Figure 29:
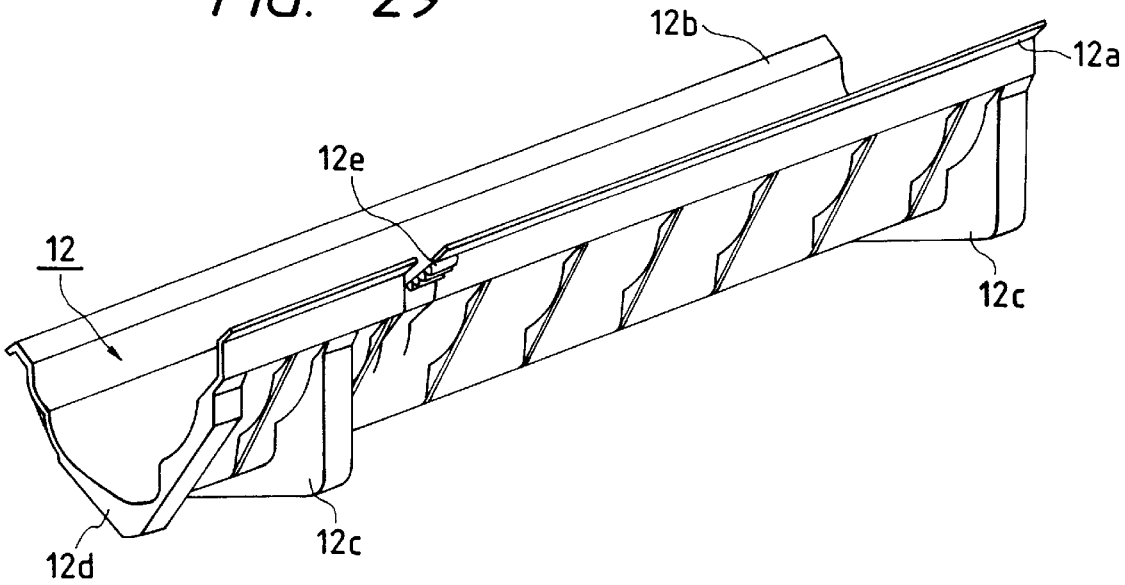
FIG. 29 is a perspective view of the protective cover.
Figure 30A:
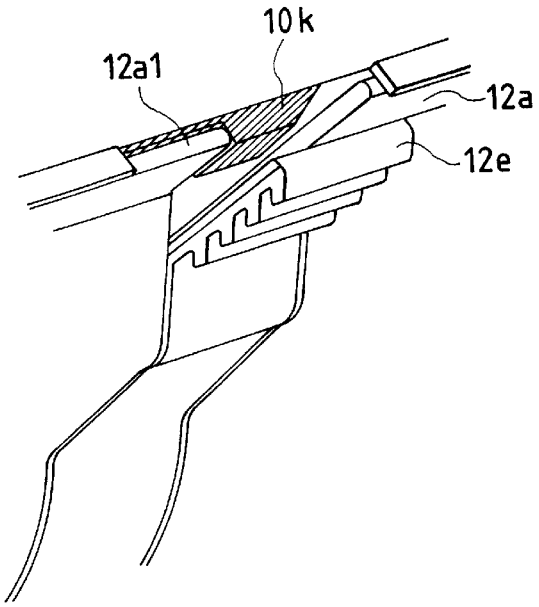
FIGS. 30A and 30B are enlarged views of an engage release lever of the protective cover.
Figure 30B:
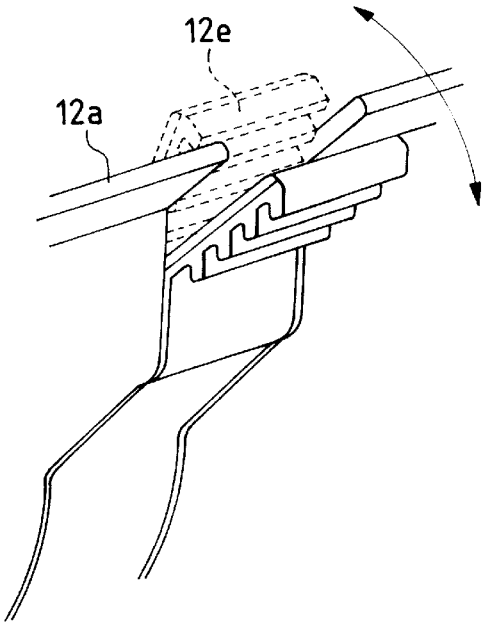

Also, in the above-described embodiment design is made such that the protective cover 12 is restrained on the process cartridge B by the engagement between the lock portion 12*a*1 provided on the guide rail 12*a* of the protective cover 12 and the lock lever 10*k* provided on the cartridge frame member 10 and said lock is released by the cartridge mounting operation, whereas this is not restrictive, but there may be adapted a construction as shown, for example, in FIG. 29 wherein an engagement releasing lever 12*e* having resiliency for pushing the lock lever 10*k* into the cartridge frame member 10 is integrally provided on a portion of the protective cover 12 which assumes the same position as the lock lever 10*k* of the cartridge frame member 10. According to this construction, when the cartridge B is to be mounted to the image forming apparatus body, simply by pushing the engagement releasing lever 12*e* as shown in FIG. 30, the lock lever 10*k* is disengaged from the lock portion 12*a*1 of the protective cover 12 and the cartridge B becomes freely movable on the guide rail 12*a*.

Also, the engagement releasing lever 12*e* is disposed more adjacent to the fore end side in the direction of insertion of the cartridge than to the center of the protective cover 12 as shown in FIG. 1, whereby the user can push the engagement releasing lever 12*e* by his one hand and insert the cartridge B by his other hand and therefore, the mounting of the cartridge becomes easier. Also, the above-described cartridge B according to the present invention can suitably be applied to a cartridge for forming a monochromatic image or a cartridge provided with a plurality of developing means to form a plurality of colors of images (such as a two-color image, a three-color image or a full color image).

Also, as the developing method, use can be made of one of various methods such as the conventional two-component magnetic brush developing method, the cascade developing method, the touch-down developing method, the cloud developing method, etc.

Also, in the above-described first embodiment, the so-called contact charging method is used for the construction of the charging means, but as an alternative construction, use may of course be made of a construction in which a metallic shield of aluminum or the like is; applied to the periphery of conventionally used tungsten wire and positive or negative ions created by a high voltage being applied to the tungsten wire are moved to the surface of a photosensitive drum to thereby uniformly charge the surface of the drum.

The charging means is not limited to the above-described roller type, but may be of the blade type (charging blade), the pad type, the block type, the rod type, the wire type or the like.

Also, as the cleaning method for the toner remaining on the photosensitive drum, cleaning means may be constructed by the use of a blade, a fur brush, a magnetic brush or the like.

The above-described process cartridge refers to one provided with an electrophotographic photosensitive member or the like and at least one process means. Accordingly, the possible modes of the process cartridge include not only that of the above-described embodiment, but for example, one comprising an electrophotographic photosensitive member and charging means integrally made into a cartridge so as to be removably mountable to the apparatus body, one comprising an electrophotographic photosensitive member and developing means integrally made into a cartridge so as to be removably mountable to the apparatus body, one comprising an electrophotographic photosensitive member and cleaning means integrally made into a cartridge so as to be removably mountable to the apparatus body and further, one comprising an electrophotographic photosensitive member and two or more of said process means combined together and integrally made into a cartridge so as to be removably mountable to the apparatus body. That is, the above-described cartridge refers to one comprising charging means, developing means or cleaning means and an electrophotographic photosensitive member integrally made into a cartridge so as to be removably mountable to the body of the image forming apparatus, one comprising at least one of charging means, developing means and cleaning means and an electrophotographic photosensitive member integrally made into a cartridge so as to be removably mountable to the image forming apparatus body, or one comprising at least cleaning means and an electrophotographic photosensitive member integrally made into a cartridge so as to be removably mountable to the apparatus body.

Also, in the above-described embodiment, a color image forming apparatus has been exemplarily shown as the image forming apparatus, where as the present invention need not be restricted thereto, but can be suitably applied, for example, even to an image forming apparatus for recording monochromatic images.

Also, in the above-described embodiment a laser beam printer has been exemplarily shown as the image forming apparatus, whereas the present invention need not be restricted thereto, but of course can also be applied to other image forming apparatuses such as an electrophotographic copying apparatus, a facsimile apparatus or a word processor.

The present invention is not restricted to the above-described embodiments, but covers all modifications following within the same technical idea.

What is claimed is:

1. A process cartridge removably mountable to a main body of an image forming apparatus, said process cartridge comprising:

a drum-like rotatable member having an electrophotographic photosensitive layer, said rotatable member having an abutted surface at one axial end thereof against which a spacer attached to a developing sleeve opposed to said drum-like rotatable member is abutted for keeping a distance between said electrophotographic photosensitive layer and the developing sleeve at a predetermined value;

process means for acting on said electrophotographic photosensitive layer; and a raised fabric-like cleaning member disposed at a position where it faces the abutted surface and where the developing sleeve supplies toner to said electrophotographic photosensitive layer so that fabric abuts against said abutted surface of said drum-like rotatable member, said raised fabric-like cleaning member including fibers of which distal ends are bent and inclined in a direction counter to a rotational direction of said drum-like rotatable member, said raised fabric-like cleaning member storing toner removed from said drum-like rotatable member therein.

2. A process cartridge according to claim 1, wherein said process means is at least one of charging means for charging said electrophotographic photosensitive layer, developing means for supplying developer to said electrophotographic photosensitive layer, and cleaning means for removing residual matter from said electrophotographic photosensitive layer.

3. A process cartridge according to claim 1, wherein the spacer is provided coaxially with the developing sleeve, between the developing sleeve and said rotatable member.

4. An image forming apparatus comprising:

a mount for mounting a process cartridge including a drum-like rotatable member having an electrophotographic photosensitive layer and having an abutted surface at one axial end thereof against which a spacer attached to a developing sleeve opposed to said drum-like rotatable member is abutted for keeping a distance between the electrophotographic photosensitive layer and the developing sleeve at a predetermined value, process means for acting on the electrophotographic photosensitive layer, and a raised fabric-like cleaning member disposed at a position where it faces the abutted surface of said drum-like rotatable member and where the developing sleeve supplies toner to said electrophotographic photosensitive layer so that fabric of said cleaning member abuts against the abutted surface of said drum-like rotatable member, said raised fabric-like cleaning member including fibers of which distal ends are bent and inclined in a direction counter to a rotational direction of said drum-like rotatable member, said raised fabric-like cleaning member storing toner removed from said drum-like rotatable member therein; and conveying means for conveying a recording material.

* * * * *

UNITED STATES PATENT AND TRADEMARK OFFICE

CERTIFICATE OF CORRECTION

PATENT NO. : 6,044,235

DATED : March 28, 2000

INVENTOR(S): KOUJI HASHIMOTO

It is certified that error appears in the above-identified patent and that said Letters Patent is hereby corrected as shown below:

COLUMN 1:
Line 31, "p m." should read --$\mu$m.--.

COLUMN 3:
Line 58, "of-the" should read --of the--.

COLUMN 5:
Line 4, "block" should read --black--.

COLUMN 6:
Line 39, "lengthwisely" should read --lengthwise--.

COLUMN 7:
Line 17, "wisely" should read --wise--.

COLUMN 8:
Line 22, "lengthwisely" should read --lengthwise--.
Line 35, "toward" should read --toward and--.
Line 43, "become" should read --becomes--.
Line 60, "lengthwise" should read --lengthwise--.
Line 62, "tie" should read --the--.

UNITED STATES PATENT AND TRADEMARK OFFICE

CERTIFICATE OF CORRECTION

PATENT NO. : 6,044,235

DATED : March 28, 2000

INVENTOR(S): KOUJI HASHIMOTO

It is certified that error appears in the above-identified patent and that said Letters Patent is hereby corrected as shown below:

COLUMN 9:

Line 21, "conducted" should read --conductive--.

COLUMN 11:

Line 36, "lengthwisely" should read --lengthwise--.

COLUMN 12:

Line 8, "in" should be deleted

COLUMN 13:

Line 5, "Paul)" should read --Pawl)--.

Line 31, "and thereof" should read --thereof, and--.

UNITED STATES PATENT AND TRADEMARK OFFICE

CERTIFICATE OF CORRECTION

PATENT NO. : 6,044,235

DATED : March 28, 2000

INVENTOR(S): KOUJI HASHIMOTO

It is certified that error appears in the above-identified patent and that said Letters Patent is hereby corrected as shown below:

COLUMN 15:

Line 18, "before" should read --before being--.

Line 45, "operable-closable" should read --openable-closable--.

Signed and Sealed this

Eighth Day of May, 2001

*Attest:*

Nicholas P. Godici

NICHOLAS P. GODICI

*Attesting Officer*

*Acting Director of the United States Patent and Trademark Office*